US010905926B2

(12) United States Patent
Morales et al.

(10) Patent No.: US 10,905,926 B2
(45) **Date of Patent: *Feb. 2, 2021**

(54) CLUB HEADS HAVING REINFORCED CLUB HEAD FACES AND RELATED METHODS

(71) Applicant: KARSTEN MANUFACTURING CORPORATION, Phoenix, AZ (US)

(72) Inventors: Eric J. Morales, Laveen, AZ (US); Ryan M. Stokke, Anthem, AZ (US); Eric V. Cole, Phoenix, AZ (US); Cory S. Bacon, Cave Creek, AZ (US); Travis D. Milleman, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/170,593

(22) Filed: Jun. 1, 2016

(65) Prior Publication Data

US 2016/0271461 A1 Sep. 22, 2016

Related U.S. Application Data

(63) Continuation-in-part of application No. 14/710,236, filed on May 12, 2015.

(60) Provisional application No. 62/169,089, filed on Jun. 1, 2015, provisional application No. 62/266,074, filed on Dec. 11, 2015, provisional application No. 62/280,035, filed on Jan. 18, 2016, provisional application No. 61/994,029, filed on May 15, 2014, (Continued)

(51) Int. Cl.

| | |
|---|---|
| ***A63B 53/04*** | (2015.01) |
| ***A63B 60/54*** | (2015.01) |
| ***A63B 60/52*** | (2015.01) |

(52) U.S. Cl.

CPC ..... *A63B 53/047* (2013.01); *A63B 60/54* (2015.10); *A63B 53/0408* (2020.08); *A63B 53/0454* (2020.08); *A63B 53/0458* (2020.08); *A63B 60/52* (2015.10); *A63B 2053/0491* (2013.01); *Y10T 29/49828* (2015.01)

(58) Field of Classification Search

CPC ..... A63B 53/047; A63B 60/54; A63B 2053/0458; A63B 2053/0408; A63B 2053/0454; Y10T 29/49828

See application file for complete search history.

(56) References Cited

U.S. PATENT DOCUMENTS

| | | | |
|---|---|---|---|
| 1,359,220 | A | 11/1920 | Beamer |
| 5,409,229 | A | 4/1995 | Schmidt et al. |

(Continued)

FOREIGN PATENT DOCUMENTS

| | | |
|---|---|---|
| JP | H8-308967 | 11/1996 |
| JP | H9-215793 | 8/1997 |

(Continued)

OTHER PUBLICATIONS

International Search Report dated Jul. 27, 2015 from corresponding PCT Application No. PCT/US2015/030076, filed May 11, 2015.

(Continued)

*Primary Examiner* — Jeffrey S Vanderveen

(57) ABSTRACT

Some embodiments include club heads having reinforced club head faces. Other embodiments of related club heads and methods are also disclosed.

19 Claims, 8 Drawing Sheets

Related U.S. Application Data provisional application No. 62/023,819, filed on Jul. 11, 2014, provisional application No. 62/101,926, filed on Jan. 9, 2015, provisional application No. 62/146,783, filed on Apr. 13, 2015.

(56) References Cited

U.S. PATENT DOCUMENTS

| | | | | |
|---|---|---|---|---|
| 5,586,947 | A | 12/1996 | Hutin | |
| 5,595,552 | A | 1/1997 | Wright et al. | |
| 5,643,099 | A | 7/1997 | Solheim | |
| 5,649,872 | A | 7/1997 | Antonious | |
| 5,695,411 | A | 12/1997 | Wright et al. | |
| 5,776,011 | A * | 7/1998 | Su | A63B 53/04 473/345 |
| 5,873,795 | A * | 2/1999 | Wozny | A63B 60/00 473/350 |
| 6,319,149 | B1 * | 11/2001 | Lee | A63B 53/0466 473/342 |
| 6,616,546 | B2 | 9/2003 | Cho-Jung | |
| 6,849,005 | B2 | 2/2005 | Rife | |
| 6,997,820 | B2 | 2/2006 | Willett et al. | |
| RE39,178 | E | 7/2006 | Allen | |
| 7,083,530 | B2 | 8/2006 | Wahl et al. | |
| 7,192,364 | B2 | 3/2007 | Long | |
| 8,070,623 | B2 * | 12/2011 | Stites | A63B 60/00 473/329 |
| 8,246,489 | B2 * | 8/2012 | Yamamoto | A63B 53/0466 473/346 |
| 8,262,495 | B2 * | 9/2012 | Stites | A63B 53/04 473/226 |
| 8,267,807 | B2 * | 9/2012 | Takechi | A63B 60/54 473/332 |
| 8,353,785 | B2 * | 1/2013 | Ines | B23P 15/00 473/342 |
| 8,535,177 | B1 | 9/2013 | Wahl et al. | |
| 2002/0183134 | A1 | 12/2002 | Allen et al. | |
| 2007/0015601 | A1 * | 1/2007 | Tsunoda | A63B 53/04 473/346 |
| 2008/0004130 | A1 * | 1/2008 | Lin | A63B 53/04 473/342 |
| 2009/0017934 | A1 * | 1/2009 | Stites | A63B 53/0487 473/290 |
| 2009/0029796 | A1 * | 1/2009 | Mergy | A63B 53/047 473/331 |
| 2010/0279795 | A1 * | 11/2010 | Nicolette | A63B 53/047 473/350 |
| 2012/0283036 | A1 | 11/2012 | Stites et al. | |
| 2013/0165257 | A1 | 6/2013 | Dipert et al. | |

FOREIGN PATENT DOCUMENTS

| | | |
|---|---|---|
| JP | H090225075 | 9/1997 |
| JP | 20010218880 | 8/2000 |
| JP | 2002102396 | 4/2002 |
| JP | 2002331051 | 11/2002 |
| JP | 2003000773 | 1/2003 |
| JP | 2003102879 | 4/2003 |

OTHER PUBLICATIONS

Written Opinion dated Jul. 27, 2015 from corresponding PCT Application No. PCT/US2015/030076, filed May 11, 2015.

International Search Report and Written Opinion, dated Aug. 22, 2017, from corresponding PCT Application No. PCT/US2016/035290, filed Jun. 1, 2016.

* cited by examiner

1002

1200

100

CLUB HEADS HAVING REINFORCED CLUB HEAD FACES AND RELATED METHODS

CROSS REFERENCE TO RELATED APPLICATION

This claims the benefit of U.S. Provisional Patent Application No. 62/169,089, filed on Jun. 1, 2015, U.S. Provisional Patent Application No. 62/266,074, filed on Dec. 11, 2015, U.S. Provisional Patent Application No. 62/280,035, filed on Jan. 18, 2016, and is a continuation in part of U.S. Non-Provisional patent application Ser. No. 14/710,236, filed on May 12, 2015, which claims the benefit of U.S. Provisional Patent Application No. 61/994,029, filed on May 15, 2014, U.S. Provisional Patent Application No. 62/023,819, filed on Jul. 11, 2014, U.S. Provisional Patent Application No. 62/101,926, filed on Jan. 9, 2015, U.S. Provisional Patent Application No. 62/146,783, filed on Apr. 13, 2015, the contents of all disclosures above are incorporated fully by reference herein.

TECHNICAL FIELD

This disclosure relates generally to sports equipment, and relates more particularly to golf club heads and related methods.

BACKGROUND

Various characteristics of a golf club can affect the performance of the golf club. For example, the center of gravity, the moment of inertia, and the coefficient of restitution of the club head of the golf club are each characteristics of a golf club that can affect performance.

The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

Further, the coefficient of restitution of the club head of the golf club can be a function of at least the flexibility of the face of the club head. Meanwhile, the flexibility of the face of the club head can be a function of the geometry (e.g., height, width, and/or thickness) of the face and/or the material properties (e.g., Young's modulus) of the face. That is, maximizing the height and/or width of the face, and/or minimizing the thickness and/or Young's modulus of the face, can increase the flexibility of the face, thereby increasing the coefficient of restitution of the club head; and increasing the coefficient of restitution of the club head of the golf club, which is essentially a measure of the efficiency of energy transfer from the club head to a golf ball, can increase the distance the golf ball travels after impact, decrease the spin of the golf ball, and/or increase the ball speed of the golf ball.

However, although thinning the face of the club head can permit mass from the face to be redistributed to other parts of the club head and can make the face more flexible, thinning the face of the club head also can result in increased bending in the face to the point of buckling and failure. Accordingly, devices and methods for preventing the face of a club head from buckling as the face of the club head is thinned are needed.

BRIEF DESCRIPTION OF THE DRAWINGS

To facilitate further description of the embodiments, the following drawings are provided in which.

Figure 1:
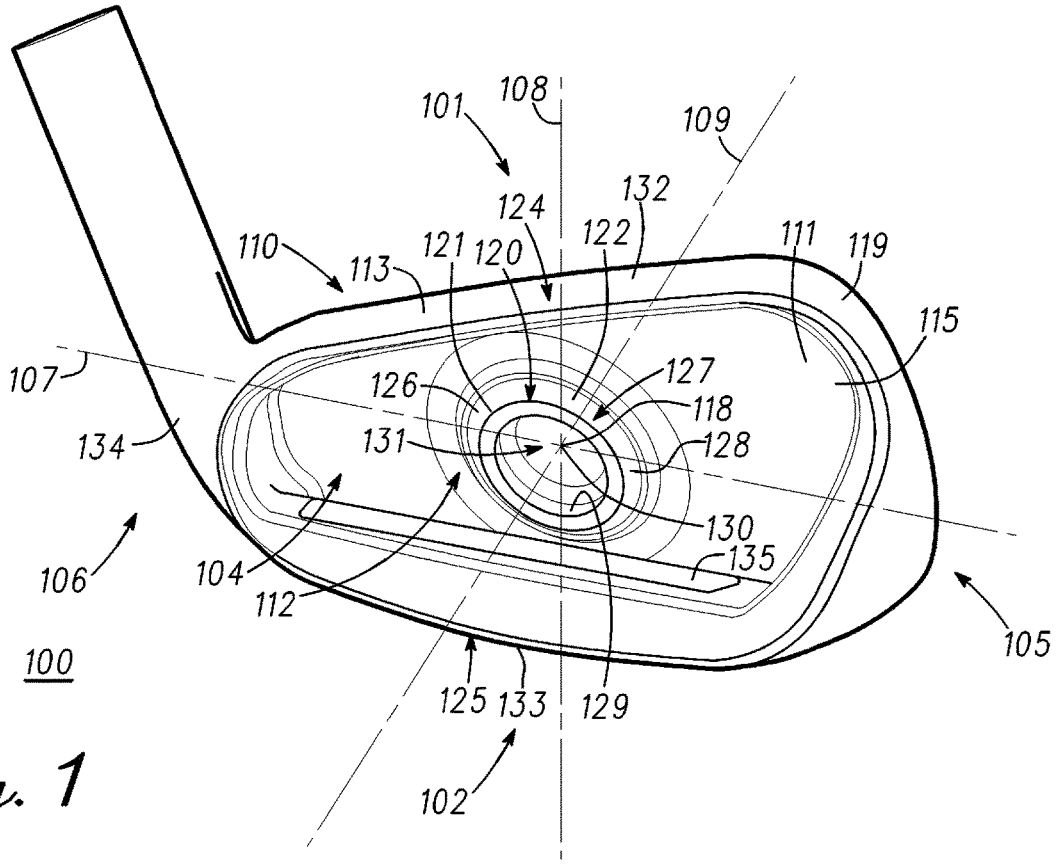
FIG. 1 illustrates a top, rear, toe side view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

Some embodiments include a golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Other embodiments include a golf club head. In some embodiments, the golf club head comprises an iron-type golf club head. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. Even further still, the golf club head comprises a perimeter wall element (i) extending out from the rear surface toward the rear end and away from the front end and (ii) extending entirely around the perimeter of the rear surface. The perimeter wall element comprises a first perimeter wall portion extending along the perimeter of the rear surface at the top end and a second perimeter wall portion extending along the perimeter of the rear surface at the bottom end. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a closed circular looped rib. Also, the golf club head comprises an iron-type golf club head, a center thickness from the face center to the rear center is less than or equal to approximately 0.203 centimeters, and at least part of the second perimeter wall portion is thinner than is the face element proximal to the face perimeter.

Some embodiments further include an insert that at least partially fills in a cavity of the reinforcement element that is formed by the looped rib. In some embodiments, the cavity can be a central cavity. The central cavity can also be partially covered by a badge. The badge can be separate from the insert or integral with the insert. In other embodiments, the badge can be integral with the reinforcement element. The insert can be of a lightweight material of about 3 g or less and may not significantly affect the center of gravity of the swing of the golf club head. In alternative embodiments, the insert can weigh more than 3 g, such as between 5 g and 10 g, and may contribute to the swing weight or the center of gravity of the club head.

Further embodiments include a vibration attenuating feature disposed on the rear surface of the golf club head to reduce noise, to produce a more desirable sound, and to reduce vibration of the golf club head. The vibration attenuating feature can be composed of any material or composition capable of damping or removing vibrations such as damping foil, rubber, or pressure sensitive viscoelastic acrylic polymer. The vibration attenuating feature may be pressure sensitive, leading to lessening or removal of vibration from the golf club head when a golf ball is struck. The viscoelastic damping feature provides the golf club head with a more desirable sound combined with getting greater performance in a thin-face golf club head. The vibration attenuating feature is at least partially applied to the rear surface of the golf club head. The vibration attenuating feature can also be applied to the reinforcement element. The vibration attenuating feature may be further applied to all or part of the cavity of the reinforcement element. The cavity can be a central cavity. The central cavity of the rear surface can also be partially covered by the vibration attenuating feature. The central cavity can also be partially covered by a badge, and the vibration attenuating feature can be disposed beneath the badge.

Further embodiments include a method of providing a golf club head. The method can comprise: providing a face element comprising: (i) a face surface located at the front end and comprising a face center and a face perimeter; and (ii) a rear surface located at the rear end and being approximately opposite to the face surface, the rear surface comprising a rear center approximately opposite the face center and a rear perimeter; and providing a reinforcement device at the rear surface. In these embodiments, the golf club head comprises a top end and a bottom end opposite the top end, a front end and a rear end opposite the front end, and a toe end and a heel end opposite the toe end. Further, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further still, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Meanwhile, the reinforcement device comprises a reinforcement element comprising a geometric center approximately located at the z-axis, the reinforcement element extends out from the rear surface toward the rear end and away from the front end, and the reinforcement element comprises a looped rib. Also, the face surface can be nearer to the rear surface proximal to the face center than proximal to the face perimeter.

Some embodiments include a golf club. The golf club comprises a shaft and a golf club head coupled to the shaft. The golf club head comprises a top end and a bottom end opposite the top end, a front end and a rear end opposite the front end, and a toe end and a heel end opposite the toe end. Further, the golf club head comprises a face element. The face element comprises a face surface located at the front end, and the face surface comprises a face center and a face perimeter. Also, the face element comprises a rear surface located at the rear end and being approximately opposite to the face surface, and the rear surface comprises a rear center approximately opposite the face center and a rear perimeter. Further still, the golf club head comprises a reinforcement device located at the rear surface. In these embodiments, an x-axis extends approximately parallel to the face surface and intersects the rear center; a y-axis extends approximately parallel to the face surface, extends approximately perpendicular to the x-axis, and intersects the rear center; and a z-axis extends approximately perpendicular to the face surface, extends approximately perpendicular to the x-axis and the y-axis, and intersects the rear center. Further, the x-axis extends through the toe end and the heel end and equidistant between the top end and the bottom end; the y-axis extends through the top end and the bottom end and equidistant between the toe end and the heel end; and the z-axis extends through the front end and the rear end and equidistant (i) between the toe end and the heel end and (ii) between the top end and the rear end. Further in these embodiments, the reinforcement device comprises a reinforcement element comprising a geometric center approximately located at the z-axis, the reinforcement element extends out from the rear surface toward the rear end and away from the front end, and the reinforcement element comprises a looped rib. Meanwhile, the face surface can be nearer to the rear surface proximal to the face center than proximal to the face perimeter.

Figure 2:
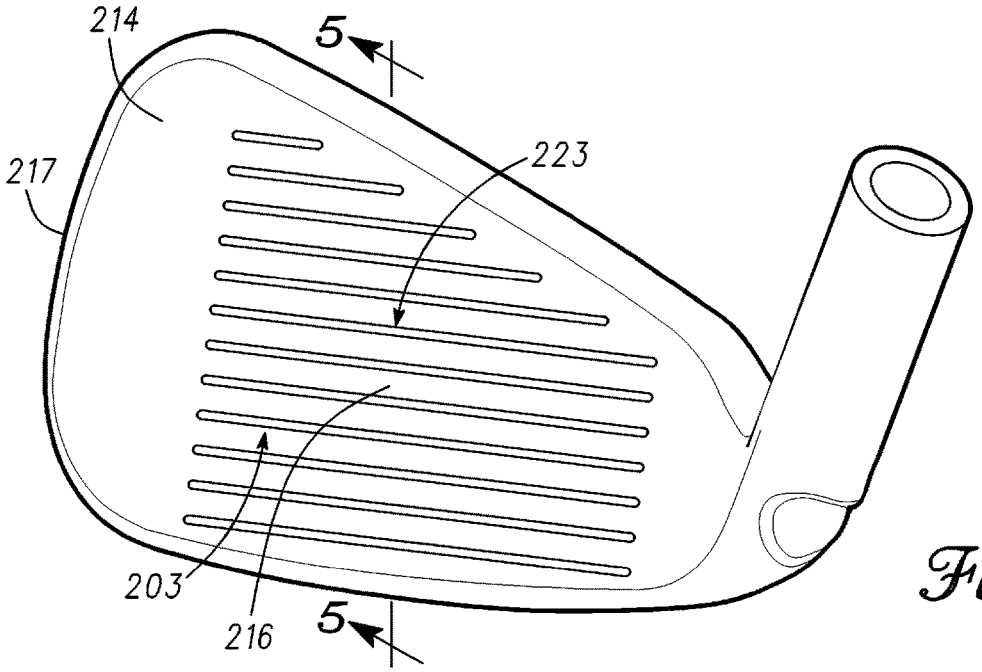
FIG. 2 illustrates a top, front, heel side view of the club head, according to the embodiment of FIG. 1.

Turning to the drawings, FIG. 1 illustrates a top, rear, toe side view of a club head 100, according to an embodiment. Meanwhile, FIG. 2 illustrates a top, front, heel side view of club head 100, according to the embodiment of FIG. 1. Club head 100 is merely exemplary and is not limited to the embodiments presented herein. Club head 100 can be employed in many different embodiments or examples not specifically depicted or described herein.

Figure 14:
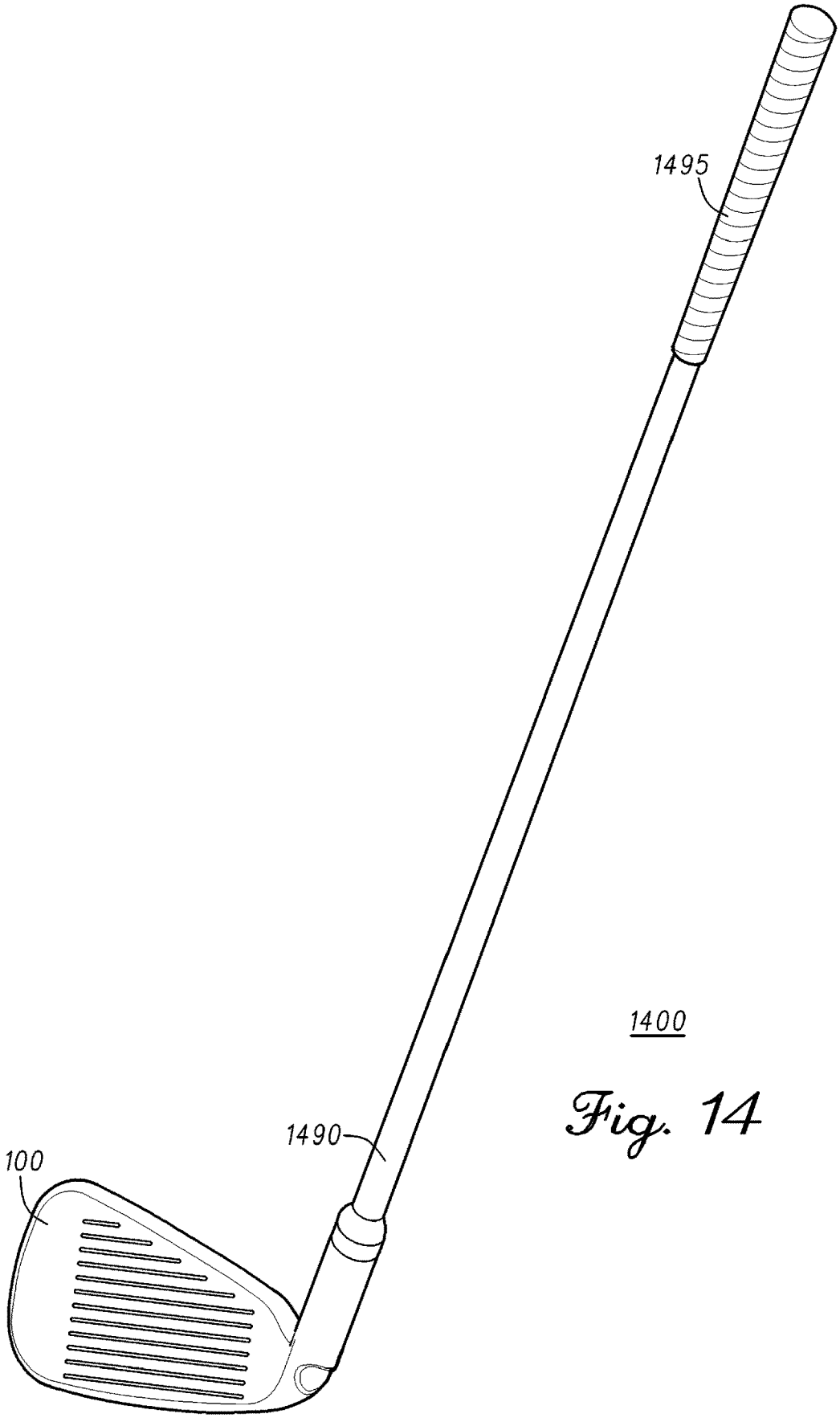
FIG. 14 illustrates a front view of a golf club, according to an embodiment.

Generally, club head 100 can comprise a golf club head. Golf club head 100 can be part of a corresponding golf club. For example, a golf club 1400 (FIG. 14) can comprise golf club head 100 coupled to a shaft 1490 and a grip 1495. Further, the golf club head can be part of a set of golf club heads, and/or the golf club can be part of a set of golf clubs. For example, club head 100 can comprise any suitable iron-type golf club head. In some embodiments, club head 100 can comprise a muscle-back iron-type golf club head or cavity-back iron-type golf club head. Nonetheless, although club head 100 is generally described with respect to a iron-type golf club head, club head 100 can comprise any other suitable type of golf club head, such as, for example, a wood-type golf club head (e.g., a driver club head, a fairway wood club head, a hybrid club head, etc.) or a putter golf club head. Generally, club head 100 can comprise any suitable materials, but in many embodiments, club head 100 comprises one or more metal materials. Notwithstanding the foregoing, the apparatus, methods, and articles of manufacture described herein are not limited in this regard.

For reference purposes, club head 100 comprises a top end 101 and a bottom end 102 opposite top end 101, a front end 203 (FIG. 2) and a rear end 104 opposite front end 203 (FIG. 2), and a toe end 105 and a heel end 106 opposite toe end 105. Also, club head 100 comprises an x-axis 107, a y-axis 108, and a z-axis 109.

Meanwhile, x-axis 107, y-axis 108, and z-axis 109 provide a Cartesian reference frame for club head 100. Accordingly, x-axis 107, y-axis 108, and z-axis 109 are perpendicular to each other. Further, x-axis 107 extends through toe end 105 and heel end 106 and is equidistant between top end 101 and bottom end 102; y-axis 108 extends through top end 101 and bottom end 102 and is equidistant between toe end 105 and heel end 106; and z-axis 109 extends through front end 203 (FIG. 2) and rear end 104 and is equidistant (i) between toe end 105 and heel end 106 and (ii) between top end 101 and rear end 102.

In implementation, club head 100 comprises a club head body 110. Club head body 110 can be solid, hollow, or partially hollow. When club head body 110 is hollow and/or partially hollow, club head body 110 can comprise a shell structure, and further, can be filled and/or partially filled with a filler material different from a material of shell structure. For example, the filler material can comprise plastic foam.

Club head body 110 comprises a face element 111 and a reinforcement device 112. In many embodiments, club head body 110 can comprise a perimeter wall element 113.

In many embodiments, face element 111 comprises a face surface 214 (FIG. 2) and a rear surface 115. Meanwhile, face surface 214 (FIG. 2) comprises a face center 216 (FIG. 2) and a face perimeter 217 (FIG. 2), and rear surface 115 comprises a rear center 118 and a rear perimeter 119. Face surface 214 (FIG. 2) can refer to a striking face or a striking plate of club head 100, and can be configured to impact a ball (not shown), such as, for example, a golf ball. In many embodiments, face surface 214 (FIG. 2) can comprise one or more scoring lines 223 (FIG. 2).

In these or other embodiments, face surface 214 (FIG. 2) can be located at front end 203 (FIG. 2), and rear surface 115 can be located at rear end 104. Further, rear surface 115 can be approximately opposite to face surface 214 (FIG. 2); rear center 118 can be approximately opposite face center 216 (FIG. 2); and rear perimeter 119 can be approximately opposite face perimeter 217 (FIG. 2). Generally, in many examples, face center 216 (FIG. 2) can refer to a geometric center of face surface 214 (FIG. 2). Accordingly, in these or other examples, face center 216 (FIG. 2) can refer to a location at face surface 214 (FIG. 2) that is approximately equidistant between toe end 105 and heel end 106 and further that is approximately equidistant between top end 101 and bottom end 102. In various examples, the face center can refer to the face center as defined at *United States Golf Association: Procedure for Measuring the Flexibility of a Golf Clubhead,* USGA-TPX 3004, Revision 1.0.0, p. 6, May 1, 2008 (retrieved May 12, 2014 from http://www.usga.org/equipment/testing/protocols/Test-Protocols-For-Equipment), which is incorporated herein by reference. Likewise, in some examples, rear center 118 can refer to a geometric center of rear surface 115.

By reference, x-axis 107 and y-axis 108 can extend approximately parallel to face surface 214 (FIG. 2), and z-axis 109 can extend approximately perpendicular to face surface 214 (FIG. 2). Meanwhile, each of x-axis 107, y-axis 108, and z-axis 109 can intersect rear center 118 such that rear center 118 comprises the origin of the Cartesian reference frame provided by x-axis 107, y-axis 108, and z-axis 109.

In various embodiments, scoring lines 223 (FIG. 2) can comprise one or more grooves, respectively, and can extend between toe end 105 and heel end 106. In these or other embodiments, scoring lines 223 (FIG. 2) can be approximately parallel to x-axis 107.

In many embodiments, reinforcement device 112 comprises one or more reinforcement elements 120 (e.g., reinforcement element 121). Reinforcement device 112 and/or reinforcement element(s) 120 are located at rear surface 115 and extend out from rear surface 115 toward rear end 104 and away from front end 203 (FIG. 2). In many embodiments, each reinforcement element of reinforcement element(s) 120 comprises an outer perimeter surface and a geometric center. In these or other embodiments, the geometric center(s) of one or more of reinforcement element(s) 120 (e.g., reinforcement element 121) can be located approximately at z-axis 109. For example, reinforcement element 121 can comprise outer perimeter surface 126 and geometric center 130.

Reinforcement device 112 and reinforcement element(s) 120 are configured to reinforce face element 111 while still permitting face element 111 to bend, such as, for example, when face surface 214 (FIG. 2) impacts a ball (e.g., a golf ball). As a result, face element 111 can be thinned to permit mass from face element 111 to be redistributed to other parts of club head 100 and to make face element 111 more flexible without buckling and failing under the resulting bending. Advantageously, because face element 111 can be thinner when implemented with reinforcement device 112 and reinforcement element(s) 120 than when implemented without reinforcement device 112 and reinforcement element(s) 120, the center of gravity, the moment of inertia, and the coefficient of restitution of club head 100 can be altered to improve the performance characteristics of club head 100. For example, implementing reinforcement device 112 and reinforcement element(s) 120 can increase a flight distance of a golf ball hit with face surface 214 (FIG. 2) by increasing a launch angle of the golf ball (e.g., by approximately 1-3 tenths of a degree), increase the ball speed of the golf ball (e.g., by approximately 0.1 miles per hour (mph) (0.161 kilometers per hour (kph) to approximately 3.0 mph (4.83 kph)), and/or decreasing a spin of the golf ball (e.g., by approximately 1-500 rotations per minute). In these examples, reinforcement device 112 and reinforcement element(s) 120 can have the effect of countering some of the gearing on the golf ball provided by face surface 214 (FIG. 2).

Testing of golf clubs comprising an embodiment of golf club head 100 was performed. Overall, when compared to an iron golf club with a standard reinforced strikeface and custom tuning port, the testing showed more forgiveness, as indicated by higher moments of inertia around the x-axis and/or the y-axis and a tighter statistical area of the impact of the golf ball on the face of the golf club head. In some testing, the moment of inertia about the x-axis increased by approximately 2%, the moment of inertia about the y-axis increased by approximately 4%, and/or the statistical area of the impact of the golf ball on the face of the golf club head was reduced by approximately 15-50 percent. Additionally, increased ball speed of the golf ball, higher launch angle of the golf ball, and/or decreased spin of the golf ball were found. As an example, in testing an embodiment of golf club 100 on a 5 iron golf club, it was found that the ball speed of the golf ball increased by approximately 1.5 mph (2.41 kph), the golf ball had an approximately 0.3 degree higher launch angle, and the spin of the golf ball decreased by approximately 250 revolutions per minute (rpm). In another example, in testing an embodiment of golf club 100 on a 7 iron golf club, it was found that the ball speed of the golf ball increased by approximately 2.0 mph (3.22 kph), the golf ball had approximately no launch angle degree change, and the spin of the golf ball decreased by approximately 450 rpm. As an additional example, in testing an embodiment of golf club 100 on a wedge iron golf club, it was found that the ball speed of the golf ball had approximately no change in speed, the golf ball had an approximately 0.1 degree higher launch angle, and the spin of the golf ball decreased by approximately 200 rpm.

Figure 3:
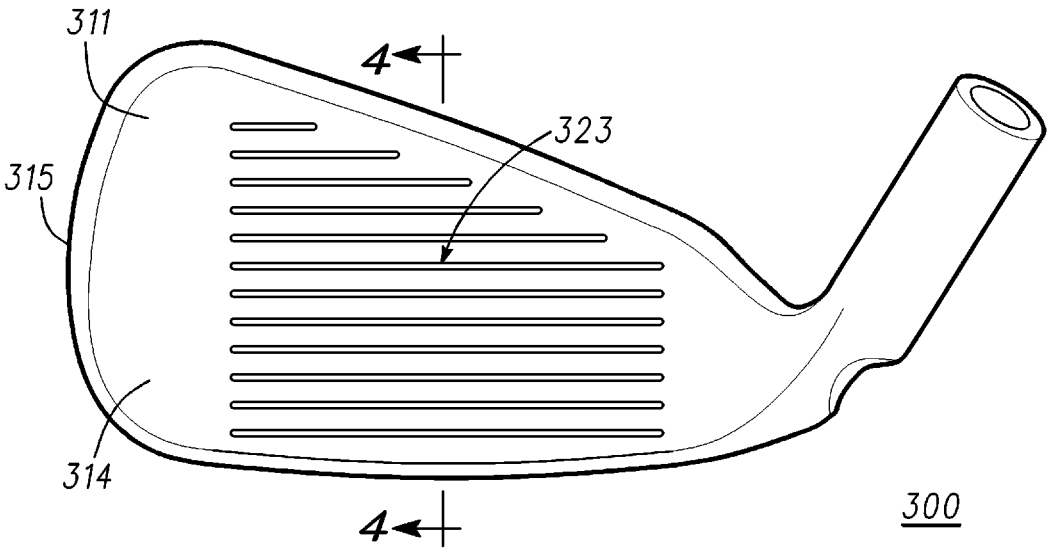
FIG. 3 illustrates a conventional club head, according to an embodiment.
Figure 4:
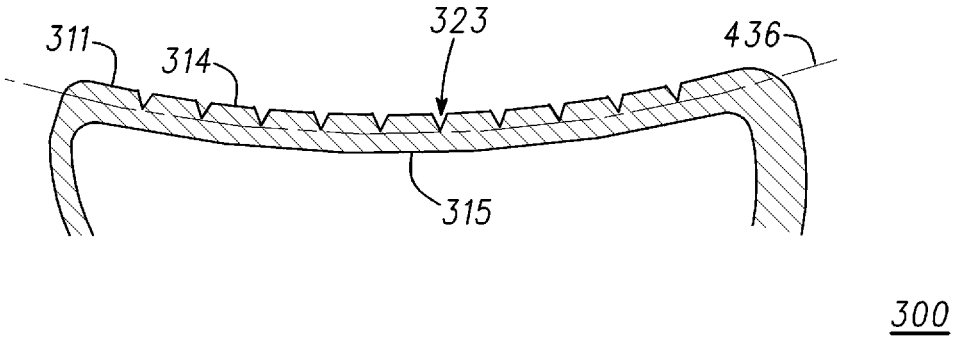
FIG. 4 illustrates a stress-strain analysis of a partial cross-sectional view of the conventional club head taken along section line 4-4 of FIG. 3 simulating a face surface of the conventional club head impacting a golf ball (not shown) where the resulting bending is multiplied three-fold, according to the embodiment of FIG. 3.

Notably, in many examples, when face element 111 comprises scoring line(s) 223 (FIG. 2) and face element 111 is thinned without implementing reinforcement device 112 and reinforcement element(s) 120, buckling and failure of face element 111 can occur at the bottom of scoring line(s) 223, particularly at scoring line(s) 223 (FIG. 2) proximal to face center 216 (FIG. 2), as illustrated at FIGS. 3 & 4 and described as follows with respect to FIGS. 3 & 4.

Club head 100 having reinforcement device 112 may also have a uniform transition thickness 550 (FIG. 5) extending from front end 203 to bottom end 102. Uniform transition thickness 550 absorbs stress directed to the region of club head 100 having reinforcement device 112 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

Specifically, turning ahead in the drawings, FIG. 3 illustrates conventional club head 300, according to an embodiment. Club head 300 can be similar to club head 100 (FIGS. 1 & 2), but unlike club head 100, is devoid of a reinforcement device and reinforcement elements at rear surface 315 of face element 311 of club head 300. Club head 300 comprises one or more scoring lines 323 at face surface 314 of club head 300. Rear surface 315 can be similar to rear surface 115 (FIG. 1); face element 311 can be similar or identical to face element 111 (FIG. 1); face surface 314 can be similar or identical to face surface 214 (FIG. 2); and/or scoring line(s) 323 can be similar or identical to scoring lines 223 (FIG. 2). Further, the absent reinforcement device can be similar to reinforcement device 112 (FIG. 1) and the absent reinforcement element(s) can be similar to reinforcement element(s) 120 (FIG. 1). Meanwhile, FIG. 4 illustrates a stress-strain analysis of a partial cross-sectional view of club head 300 taken along section line 4-4 of FIG. 3 simulating face surface 314 of club head 300 impacting a golf ball (not shown) where the resulting bending is multiplied three-fold, according to the embodiment of FIG. 3.

As demonstrated at FIG. 4, face element 311 behaves similarly to a simply supported beam and thus comprises neutral axis 436. The portion of face element 311 between face surface 314 and neutral axis 436 is in compression, and the portion of face element 311 between neutral axis 436 and rear surface 315 is in tension. Stress builds first at face surface 314 and rear surface 315 and moves inward toward neutral axis 436. However, unlike a simply supported beam, face element 311 also comprises scoring line(s) 323 at the portion of face element 311 that is in compression. When face element 311 bends too much, the mechanical yield of face element 311 in the bottom of scoring line(s) 323 can be reached. If not for scoring line(s) 323, face element 311 would ordinarily be expected to fail first in the portion of face element 311 that is under tension, but scoring line(s) 323 cause failure to occur first at the portion of face element 311 that is in compression. Namely, face element 311 fails at scoring line(s) 323 before the remainder of face element 311 has a chance to reach high enough stress levels to result in failure. Iron-type club heads can be more susceptible to failure at scoring line(s) 323 because iron-type club heads tend to be flat at face surface 314, unlike wood-type golf club head which tend to be convex at face surface 314. As a result, when wood-type golf club heads bend at face surface 314, face surface 314 can still be bowed somewhat outward. On the other hand, when iron-type golf club heads bend at face surface 314, face surface 314 can bend to a concave shape that increases the extent of the compression at the portion of face element 311 that is under compression.

Turning now back to FIGS. 1 & 2, implementing reinforcement device 112 and reinforcement element(s) 120 can reinforce a localized bending in scoring line(s) 223 (FIG. 2), particularly in those scoring line(s) of scoring line(s) 223 that are proximal to face center 216 (FIG. 2), while permitting increased overall bending in face element 111. Reinforcement device 112 and reinforcement element(s) 120 are able to provide these benefits by increasing the localized thickness of face element 111, making face element 111 stiffer and harder in those locations. In effect, reinforcement device 112 and reinforcement element(s) 120 are operable to pull a neutral axis of face element 111 away from face surface 214 (FIG. 2) and closer to rear surface 115.

Meanwhile, reinforcement device 112 and reinforcement element(s) 120 are further able to provide these benefits when implemented as a closed structure (e.g., one or more looped ribs) because such closed structures are able to resist deformation as a result of circumferential (i.e., hoop) stresses acting on reinforcement device 112 and reinforcement element(s) 120. For example, circumferential (i.e., hoop) stresses acting on reinforcement device 112 and reinforcement element(s) 120 can prevent opposing sides of reinforcement device 112 and reinforcement element(s) 120 from rotating away from each other, thereby reducing bending.

Further, reinforcement device 112 and reinforcement element(s) 120 absorb a substantial portion of the stress on club head 100 at impact, thereby preventing stress from being absorbed by other portions of club head 100 at impact, such as face element 111, face surface 214, and rear surface 115. Directing stress toward reinforcement device 112 and reinforcement element(s) 120 improves the durability of face element 111 and club head 100 compared to club head 300, devoid of a reinforcement device and reinforcement elements, or compared to a club head having reinforcement device 112 without or with fewer reinforcement element(s) 120.

In implementation, reinforcement element(s) 120 (e.g., reinforcement element 121) can be implemented in any suitable shape(s) (e.g., polygonal, elliptical, circular, etc.) and/or in any suitable arrangement(s) configured to perform the intended functionality of reinforcement device 112 and/or reinforcement element(s) 120 as described above. Further, when reinforcement element(s) 120 comprise multiple reinforcement elements, two or more reinforcement elements of reinforcement element(s) 120 can be similar to another, and/or two or more reinforcement elements of reinforcement element(s) 120 can be different from another.

In some embodiments, reinforcement element(s) 120 (e.g., reinforcement element 121) can be symmetric about x-axis 107 and/or y-axis 108. When reinforcement element(s) 120 (e.g., reinforcement element 121) are implemented with an oblong shape, in many embodiments, a largest dimension (e.g., major axis) of the reinforcement element(s) can be parallel and/or co-linear with one of x-axis 107 or y-axis 108. However, in other embodiments, the largest dimension (e.g., major axis) can be angled with respect to x-axis 107 and/or y-axis 108, as desired. Further, in many embodiments, reinforcement element(s) 120 (e.g., reinforcement element 121) can be centered at z-axis 109, but in some embodiments, one or more of reinforcement element(s) 120 (e.g., reinforcement element 121) can be biased off-center of z-axis 109, such as, for example, biased toward one or two of top end 101, bottom end 102, toe end 105, and heel end 106.

In many embodiments, each reinforcement element of reinforcement element(s) 120 (e.g., reinforcement element 121) can comprise one or more looped ribs 127 (e.g., looped rib 122). Specifically, reinforcement element 121 can comprise looped rib 122. In these or other embodiments, when looped rib(s) 127 comprise multiple looped ribs, looped rib(s) 127 can be concentric with each other about a point and/or axis (e.g., z-axis 109). In other embodiments, when looped rib(s) 127 comprise multiple looped ribs, two or more of looped rib(s) 127 can be nonconcentric. Further, in these or other embodiments, two or more of looped rib(s) 127 can overlap. Meanwhile, in these embodiments, looped rib 122 can comprise an elliptical looped rib, and in some of these embodiments, looped rib 122 can comprise a circular looped rib. As noted above, implementing reinforcement element(s) 120 as looped rib(s) 127 can be advantageous because of the circumferential (e.g., hoop) stress provided by the closed structure of looped rib(s) 127. In many embodiments, one or more of (or each of) looped rib(s) 127 is a continuous closed loop.

In these or other embodiments, each looped rib of looped rib(s) 127 comprises an outer perimeter surface and an inner perimeter surface. Meanwhile, in these embodiments, the outer perimeter surface of each reinforcement element (e.g., reinforcement element 121) comprises the outer perimeter surface of the looped rib corresponding to that reinforcement element (e.g., looped rib 122). For example, looped rib 122 can comprise outer perimeter surface 128 and inner perimeter surface 129. Further, inner perimeter surface 129 can be steep and substantially orthogonal at rib height 540 (FIG. 13) relative to the rear surface.

In some embodiments, one or more outer perimeter surface(s) of reinforcement element(s) 120 (e.g., outer perimeter surface 126 of reinforcement element 121) can be filleted with rear surface 115. In these or other embodiments, one or more inner perimeter surface(s) of looped rib(s) 127 (e.g., inner perimeter surface 129 of looped rib 122) can be filleted with rear surface 115. Filleting the outer perimeter surface(s) of reinforcement element(s) 120 (e.g., outer perimeter surface 126 of reinforcement element 121) with rear surface 115 can permit a smooth transition of reinforcement element(s) 120 (e.g., outer perimeter surface 126 of reinforcement element 121) into rear surface 115. Further, filleting the outer perimeter surface(s) of reinforcement element(s) 120 (e.g., outer perimeter surface 126 of reinforcement element 121) with rear surface 115 can direct stresses from impact into reinforcement element(s) 120 and away from the face surface 214. Meanwhile, outer perimeter surface(s) of reinforcement element(s) (e.g., outer perimeter surface 126 of reinforcement element 121) or inner perimeter surface(s) of looped rib(s) 127 (e.g., inner perimeter surface 129 of looped rib 122) can be filleted with rear surface 115 with a fillet 117 having a radius of greater than or equal to approximately 0.012 centimeters. For example, in some embodiments, the fillet 117 of the outer perimeter surface 126 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters. For further example, in some embodiments, the fillet 117 of the inner perimeter surface 129 with the rear surface 115 can range from approximately 0.012 centimeters to approximately 2.0 centimeters, from approximately 0.50 centimeters to approximately 3.0 centimeters, or from approximately 1.0 centimeters to approximately 4.0 centimeters.

In some embodiments, the outer perimeter surface(s) of reinforcement element(s) can be filleted directly with rear surface 115. In these embodiments, the face thickness decreases gradually along the fillet 117 from face thickness at rib height 540 to face thickness at rear surface 115.

Figure 15:
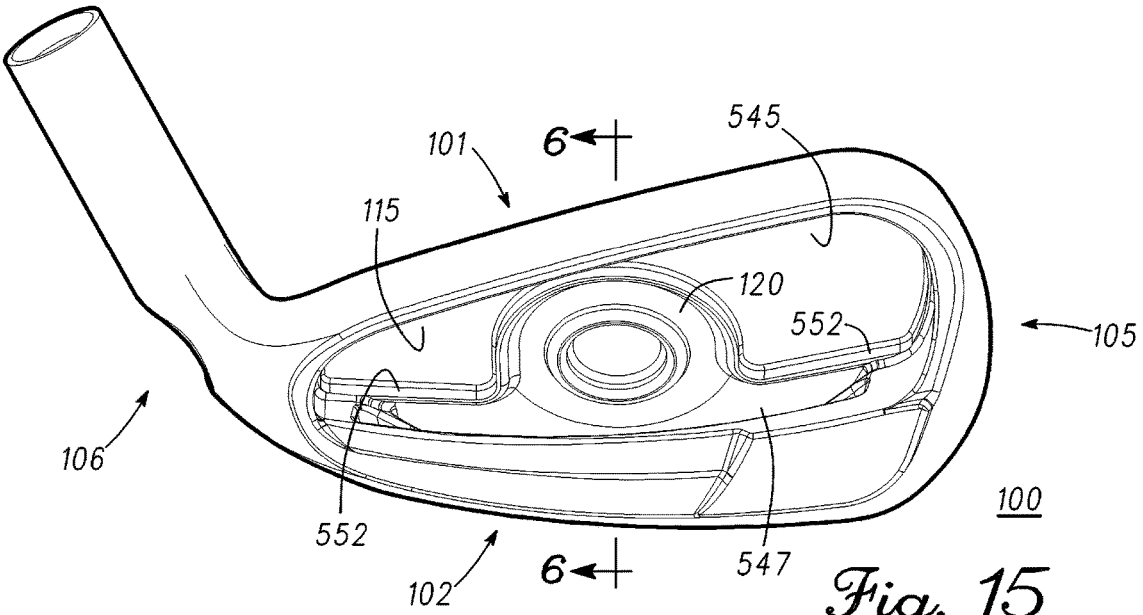
FIG. 15 illustrates a top, rear view of a club head, according to an embodiment.
Figure 16:
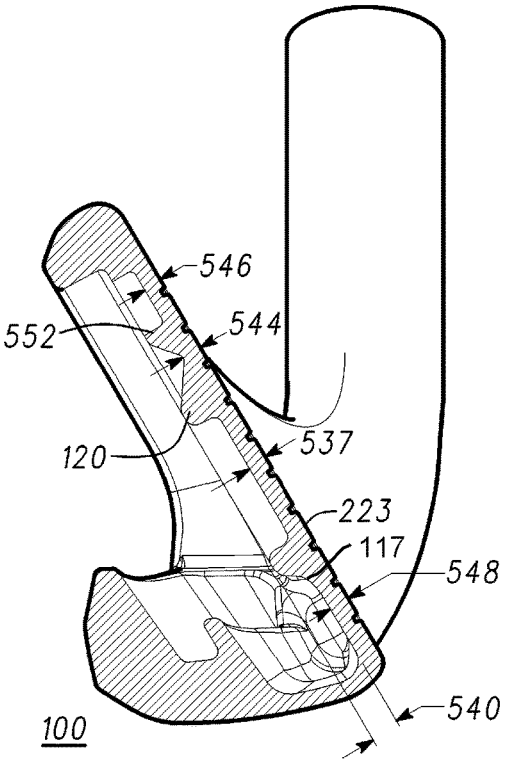
FIG. 16 illustrates a cross-sectional view of the club head taken along section line 6-6 of FIG. 15, according to the embodiment of FIG. 15.
Figure 17:
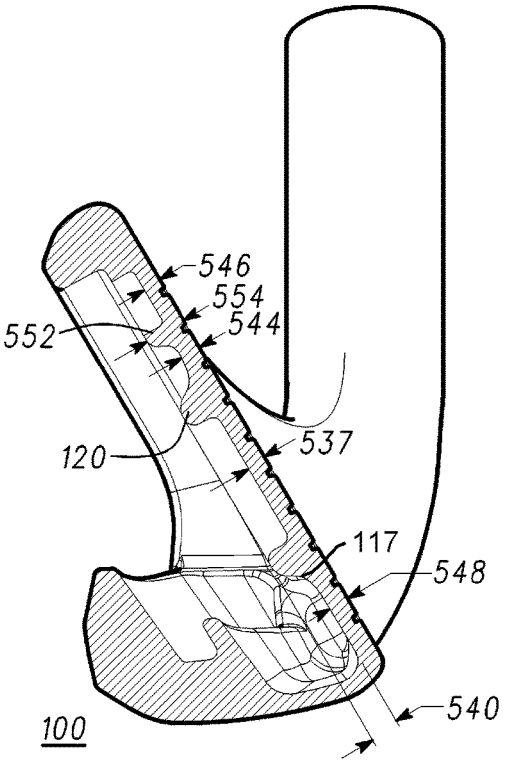
FIG. 17 illustrated a cross-sectional view of a club head according to another embodiment.

In some embodiments, club head 100 can further include a lip 552 on rear surface 115 of club head 100. Referring to FIGS. 15-17, in the illustrated embodiment, the lip 552 extends from the heel end 106 to the toe end 105 around the reinforcement element 120 of club head 100. In these or other embodiments, a fillet 117 on the outer perimeter surface of reinforcement element 120 can transition to the lip 552 such that the face thickness decreases gradually along the fillet 117 from the face thickness at rib height 540 to a minimum thickness 544, then increases gradually from the minimum thickness 544 to the face thickness at lip height 554. In these embodiments, the minimum thickness 544 between the reinforcement element 120 and the lip 552 can be greater than center thickness 537, the minimum thickness 544 between the reinforcement element 120 and the lip 552 can be approximately equal to center thickness 537, or the minimum thickness 544 between the reinforcement element 120 and the lip 552 can be less than center thickness 537. In the embodiment illustrated in FIGS. 15-16, the minimum thickness 544 between reinforcement element 120 and lip 552 is greater than center thickness 537. In the embodiment illustrated in FIG. 17, the minimum thickness 544 between reinforcement element 120 and lip 552 is approximately equal to center thickness 537.

In many embodiments, the minimum thickness 544 between the reinforcement element 120 and the lip 552 corresponds to faceplate bending and ball speed. As the minimum thickness 544 between the reinforcement element 120 and the lip 552 decreases, the outer perimeter surface of reinforcement element 120 can bend more during impact with a golf ball. Increased bending of the outer perimeter surface of reinforcement element 120 on impact allows increased faceplate deflection resulting in increased energy transfer to the golf ball and increased ball speed. For example, the golf club head 100 illustrated in FIG. 17 having a minimum thickness 544 between the reinforcement element 120 and the lip 552 approximately equal to center thickness 537 results in ball speeds up to 1 mile per hour (mph) faster than the club head 100 illustrated in FIGS. 15-16 having a minimum thickness 544 between the reinforcement element 120 and the lip 552 greater than center thickness 537.

Figure 8:
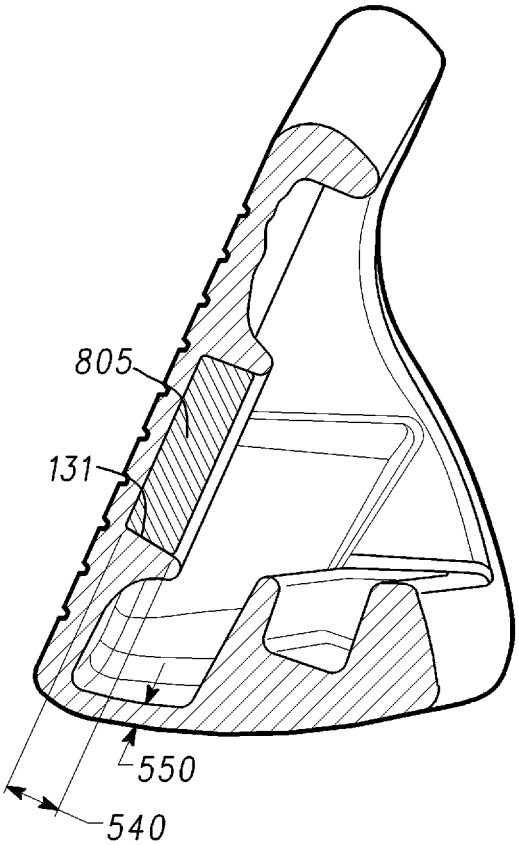
FIG. 8 illustrates a side view of the club head taken along section line 5-5 of FIG. 2, according to a different embodiment of FIG. 1.
Figure 9:
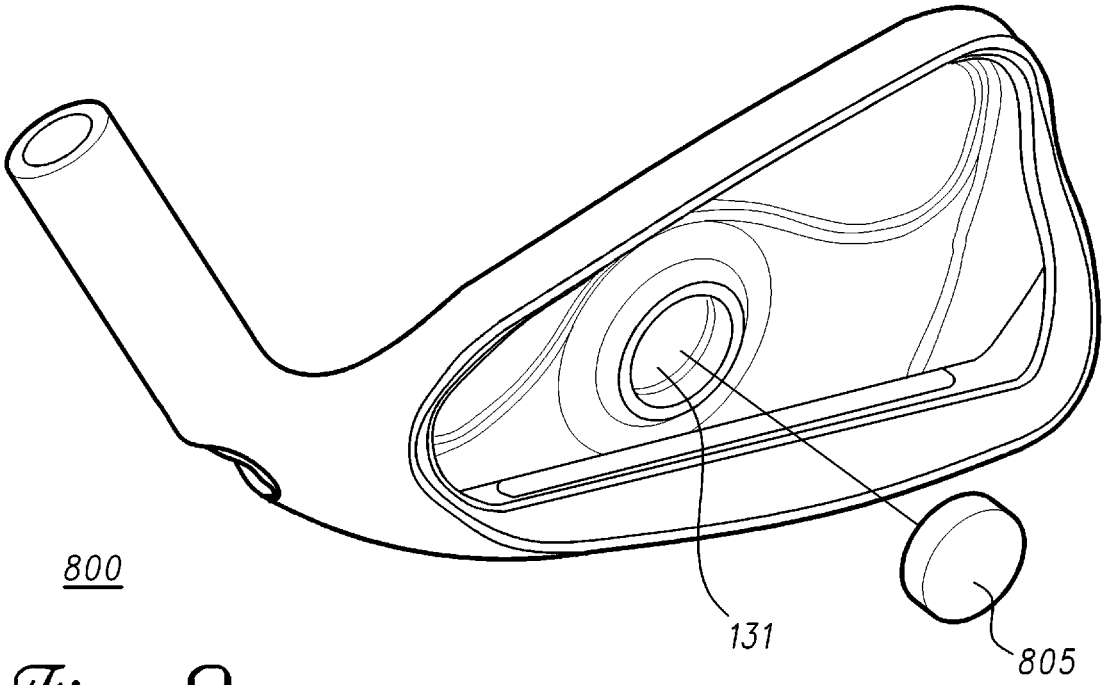
FIG. 9 illustrates a top, rear, heel side view of a club head, according to the embodiment of FIG. 8.

In some embodiments, when reinforcement element 121 comprises looped rib 122, looped rib 122 can comprise cavity 131. In other embodiments, when reinforcement element 121 comprises looped rib 122, looped rib 122 does not comprise cavity 131. In embodiments without cavity 131, the center thickness 537 (FIGS. 5 and 13) can be greater than in embodiments with cavity 131 and can be less than or equal to the face thickness at rib height 542 (FIGS. 5 and 13), which can be measured from face surface 214 (FIG. 2) to the distal end of looped rib 122 (e.g., the combined distance of center thickness 537 (FIG. 5) and rib height 542 (FIG. 5)). Cavity 131 is defined by inner perimeter surface 129 and rear surface 115. In some embodiments, cavity 131 can be a central cavity. In many embodiments, cavity 131 can be devoid of any contents, such as, for example, a weighted insert. In other embodiments, cavity 131 can contain an insert 805 as shown in FIGS. 8 and 9.

As discussed in some detail above, by implementing reinforcement device 112 and reinforcement element(s) 120, face surface 214 (FIG. 2) can be nearer to rear surface 115

(i.e., thinner) proximal to (e.g., at) face center 216 (FIG. 2) than proximal to (e.g., at) face perimeter 217 (FIG. 2). In some embodiments, a portion of face surface 214 (FIG. 2) that is proximal to face center 216 (FIG. 2) can refer to a portion of the surface area of face surface 214 bounding face center 216 (FIG. 2) and representing approximately one percent, two percent, three percent, five percent, ten percent, or twenty percent of a total surface area of face surface 214. In these or other embodiments, the portion of the surface area of face surface 214 (FIG. 2) can correspond to a portion of the surface area of rear face 115 covered by reinforcement element 121. Meanwhile, in some embodiments, a portion of face surface 214 (FIG. 2) that is proximal to face perimeter 217 (FIG. 2) can refer to a region of face surface 214 bounded by face perimeter 217 and an inset boundary located approximately 0.10 centimeters, 0.20 centimeters, 0.25 centimeters, 0.50 centimeters, 1.00 centimeters, or 2.00 centimeters from face perimeter 217 (FIG. 2).

Figure 5:
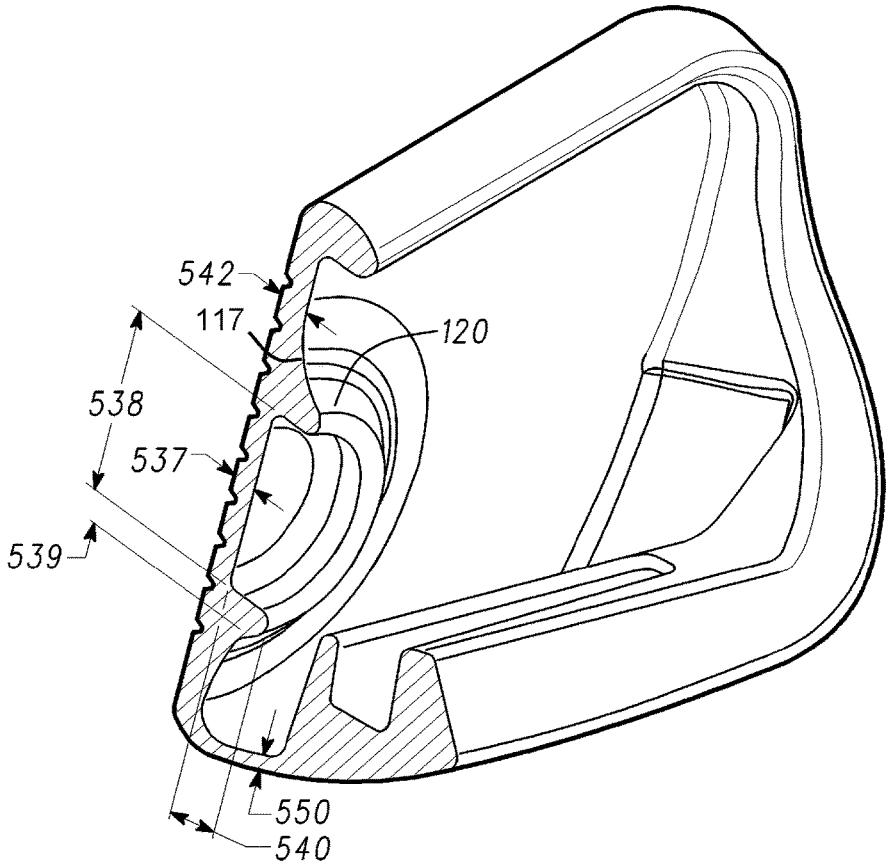
FIG. 5 illustrates a cross-sectional view of the club head taken along section line 5-5 of FIG. 2, according to the embodiment of FIG. 1.
Figure 13:
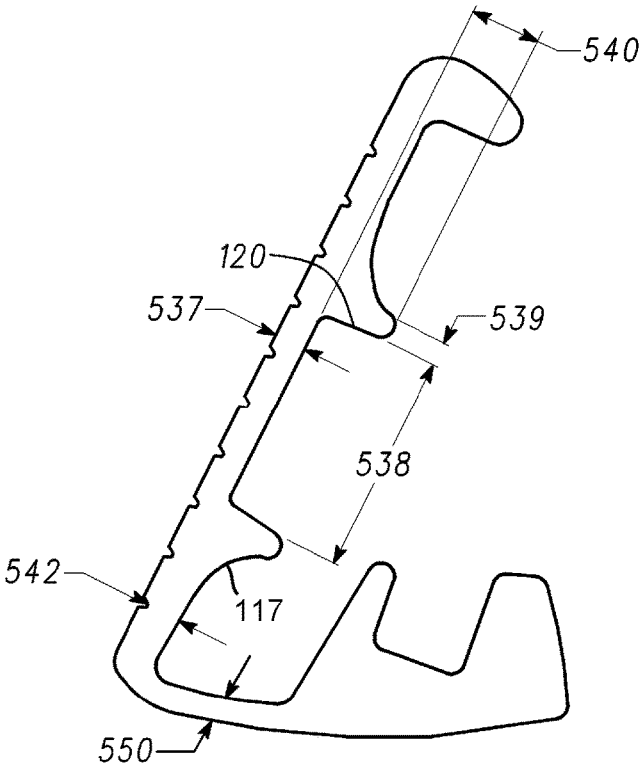
FIG. 13 illustrates a side view of the club head taken along section line 5-5 of FIG. 2, according to the embodiment of FIG. 1.

Turning ahead briefly in the drawings, FIGS. 5 and 13 illustrate a cross-sectional view of club head 100 taken along section line 5-5 of FIG. 2, according to the embodiment of FIG. 1. Club head 100 can comprise center thickness 537. Center thickness 537 can refer to a distance from face center 216 (FIG. 2) to rear center 118 (FIG. 1). In many embodiments, center thickness 537 can be approximately 0.150 cm to approximately 0.300 cm. In some embodiments, center thickness 537 can be less than 0.300 cm, less than 0.255 cm, less than 0.250 cm, less than 0.205 cm, less than 0.200 cm, or less than 0.155 cm. In some embodiments, the center of reinforcement element 120 can be at least partially filled in. For example, the center of reinforcement element 120 can be filled in with a damping material or a vibration attenuating feature (e.g., insert 805 (FIG. 8)) or other material. In many embodiments, center thickness 537 can be thinner than a face thickness at rib height 540. In other embodiments, center thickness 537 can be approximately equal to the face thickness at rib height 540. The face thickness at rib height 540 can be rib height 540 added to center thickness 537. In many embodiments, face thickness 542 outside of reinforcement element 120 can be thicker than center thickness 537, but thinner than the face thickness at rib height 540. In other embodiments, face thickness 542 can be the same as center thickness 537.

In some embodiments, face thickness at rib height 540 can be approximately 0.30 cm to approximately 0.70 cm. In some embodiments, face thickness at rib height 540 can be approximately 0.30 cm to approximately 0.50 cm. In some embodiments, face thickness at rib height 540 can be approximately 0.40 cm to approximately 0.60 cm. In some embodiments, face thickness at rib height 540 can be approximately 0.50 cm to approximately 0.70 cm. In some embodiments, face thickness at rib height 540 can be greater than 0.30 cm, greater than 0.40 cm, greater than 0.50, or greater than 0.60 cm.

In some embodiments, face thickness 542 outside of reinforcement element 120 can vary. FIGS. 15-16 illustrates a top portion 545 of faceplate outside reinforcement element 120 having a top thickness 546, and a bottom portion 547 of faceplate outside reinforcement element 120 having a bottom thickness 548. In some embodiments, top thickness 546 can be the same as bottom thickness 548 (FIGS. 5 and 13). In these embodiments, center thickness 537 can be thinner than top thickness 546 and bottom thickness 548, and top thickness 546 and bottom thickness 548 can be thinner than the face thickness at rib height 540. In some embodiments, top thickness 546 can be different than bottom thickness 548 (FIGS. 15-16). For example, in some embodiments, center thickness 537 can be thinner than top thickness 546, top thickness 546 can be thinner than bottom thickness 548, and bottom thickness 548 can be thinner than the face thickness at rib height 540. For further example, in some embodiments, top thickness 546 can be thinner than center thickness 537, center thickness 537 can be thinner than bottom thickness 548, and bottom thickness 548 can be thinner than the face thickness at rib height 540.

In many embodiments, face thickness 542 outside of reinforcement element 120 can be approximately 0.150 cm to approximately 0.300 cm. In some embodiments, face thickness 542 outside of reinforcement element 120 can be less than 0.300 cm, less than 0.255 cm, less than 0.250 cm, less than 0.205 cm, less than 0.200 cm, or less than 0.155 cm. In many embodiments, top thickness 546 can be approximately 0.150 cm to approximately 0.300 cm. In some embodiments, top thickness 546 can be less than 0.300 cm, less than 0.255 cm, less than 0.250 cm, less than 0.205 cm, less than 0.200 cm, or less than 0.155 cm. In many embodiments, bottom thickness 548 can be approximately 0.150 cm to approximately 0.300 cm. In some embodiments, bottom thickness 548 can be less than 0.300 cm, less than 0.255 cm, less than 0.250 cm, less than 0.205 cm, less than 0.200 cm, or less than 0.155 cm.

In many embodiments, face thickness 542 outside of reinforcement element 120 can be approximately 0.150 cm to approximately 0.300 cm, and center thickness 537 can be approximately 0.150 cm to approximately 0.300 cm, without requiring a backing material for support (e.g. without a filler materials such as an elastomer positioned behind the faceplate). For example, face thickness 542 outside of reinforcement element 120 can be approximately 0.150 cm to approximately 0.300 cm without having an elastomer or other flexible material positioned behind face thickness 542 outside of reinforcement element 120. For further example, center thickness 537 can be approximately 0.150 cm to approximately 0.300 cm without having an elastomer or other flexible material positioned behind face center thickness 537.

Typically, golf club head faceplates are designed to maximize ball speed (e.g. by reducing faceplate thickness) for particular swing speed requirements. Generally, faceplate thickness can be reduced with lower swing speed durability requirements (e.g. for a ladies golf club head compared to a men's golf club head), as the forces on impact with the club head decrease with swing speed. For example, a club head having lower swing speed durability requirements can have a lower center thickness 537, a lower face thickness at rib height 540, a lower top thickness 546, a lower bottom thickness 548, or any combination of the above described reductions in thickness compared to a club head with a higher swing speed durability requirement. In some embodiments, center thickness 537 can be approximately 0.150 cm to approximately 0.250 cm, top thickness 546 can be approximately 0.150 cm to approximately 0.250 cm, and bottom thickness 548 can be approximately 0.150 cm to approximately 0.250 cm, to allow the club head 100 to withstand swing speeds less than 100 miles per hour (mph) (160.9 kilometers per hour, kph), less than 90 mph (144.8 kph), less than 80 mph (128.7 kph), less than 70 mph (112.6 kph), or less than 60 mph (96.6 kph). In some embodiments, center thickness 537 can be approximately 0.200 cm to approximately 0.300 cm, top thickness 546 can be approximately 0.200 cm to approximately 0.300 cm, and bottom thickness 548 can be approximately 0.200 cm to approximately 0.300 cm, to allow the club head 100 to withstand swing speeds less than 130 mph (209.2 kph), less than 120 mph (193.1 kph), less than 110 mph (177.0 kph), less than 100 mph (160.9 kph), or less than 90 mph (144.8 kph).

In many embodiments, scoring lines 223 can have a depth of approximately 0.030 cm to approximately 0.060 cm. In some embodiments, scoring lines 223 can have a depth less than 0.060 cm, less than 0.055 cm, less than 0.050 cm, less than 0.045 cm, less than 0.040 cm, or less than 0.035 cm. For example, in the embodiment illustrated in FIGS. 15-16, the scoring lines 223 have a depth of approximately 0.046 cm. As described herein, measurements for center thickness 537, face thickness 542 outside of reinforcement element 120, top thickness 546, and bottom thickness 548 are determined in regions of the faceplate devoid of scoring lines. Accordingly, a faceplate thickness measured within a scoring line 223 will be lower (by the scoring line depth) than an associated faceplate thickness measured outside of, or adjacent to the scoring line 223 within the same region of the faceplate.

In some embodiments, a width of the rib can change throughout looped rib 122 (FIG. 1). In some embodiments, looped rib 122 (FIG. 1) and/or inner perimeter surface 129 (FIG. 1) can comprise largest rib span 538. Largest rib span 538 can refer to the largest distance from one side of inner perimeter surface 129 (FIG. 1) across to an opposing side of inner perimeter surface 129 (FIG. 1) measured parallel to rear surface 115 (FIG. 1). Accordingly, when looped rib 122 (FIG. 1) comprises an elliptical looped rib, largest rib span 538 can refer to a major axis of inner perimeter surface 129 (FIG. 1). Further, when looped rib 122 (FIG. 1) comprises a circular looped rib, largest rib span 538 can refer to a diameter of inner perimeter surface 129 (FIG. 1). Notably, in many embodiments, largest rib span 538 can be measured at a midpoint of inner perimeter surface 129 (FIG. 1).

Figure 6:
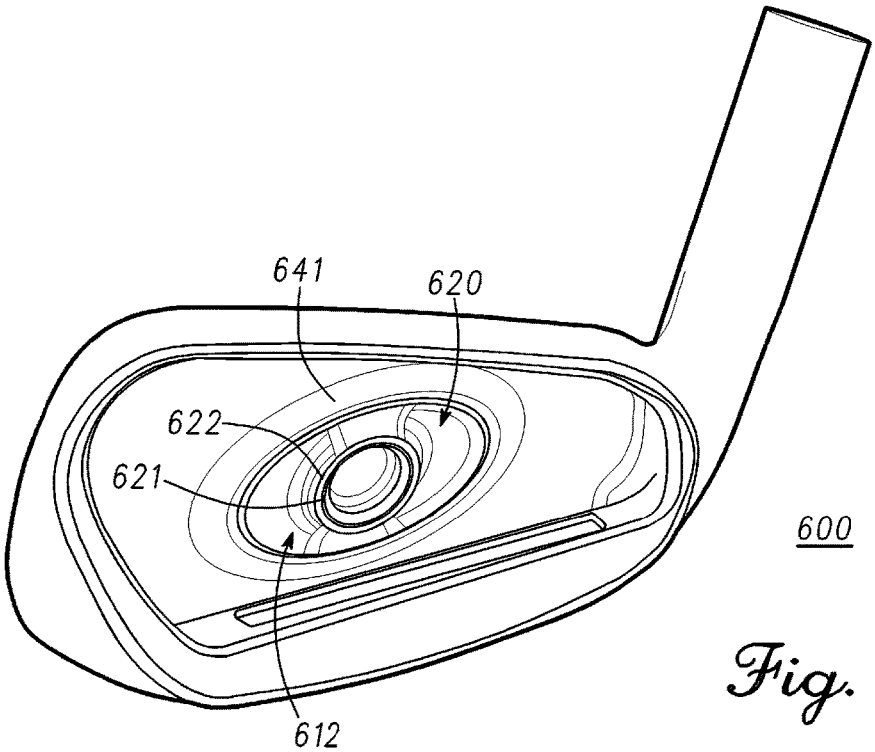
FIG. 6 illustrates a top, rear, toe side view of a club head, according to an embodiment.

In some embodiments, largest rib span 538 can be approximately 0.609 cm to approximately 1.88 cm. In some embodiments, largest rib span 538 can be approximately 1.0 cm. In some embodiments, when largest span 538 is too large (e.g., greater than approximately 1.88 centimeters), looped rib 122 (FIG. 1) can be insufficient to reinforce scoring line(s) 223 (FIG. 2) nearest to face center 216 (FIG. 2). Meanwhile, in these or other embodiments, when largest span 538 is too small (e.g., less than approximately 0.609 centimeters), looped rib 122 can be insufficient to reinforce scoring line(s) 223 (FIG. 2) nearest to face perimeter 217 (FIG. 2). Generally, these upper and lower limits on largest rib span 538 can be a function of a size of face element 111 (FIG. 1). In some embodiments, two or more ribs 621 and 641 can be present, for example as shown in FIG. 6. In this case, the larger rib span or inner or outer diameter of rib 641 (FIG. 6) can be greater than 1.88 centimeters, and the smaller rib span or inner or outer diameter of rib 621 (FIG. 6) can be less than 0.609 centimeters.

Further, looped rib 122 (FIG. 1) can comprise a rib thickness 539. Rib thickness 539 can refer to a distance between inner perimeter surface 129 (FIG. 1) of looped rib 122 (FIG. 1) and outer perimeter surface 128 (FIG. 1) of looped rib 122 (FIG. 1) measured parallel to rear surface 115 (FIG. 1). In some embodiments, the thickness of looped rib 122 (FIG. 1) can vary throughout looped rib 122 (FIG. 1), and rib thickness 539 can be a maximum rib thickness of looped rib 122 (FIG. 1). In many embodiments, rib thickness 539 can be approximately 0.050 cm to approximately 1.50 cm. In some embodiments, rib thickness 539 can be approximately 0.05 cm. In some embodiments, rib thickness 539 can be greater than or equal to approximately 0.25 centimeters. In some embodiments, rib thickness 539 can be approximately 0.50 centimeters. In some embodiments, rib thickness 539 can be approximately 0.75 centimeters. In some embodiments, rib thickness 539 can be approximately 1.00 centimeters. In some embodiments, rib thickness 539 can be approximately 1.25 centimeters. In some embodiments, rib thickness 539 can be approximately 1.50 centimeters. In various embodiments, when looped rib(s) 127 (FIG. 1) comprises multiple looped ribs, two or more looped ribs of looped rib(s) 127 (FIG. 1) can comprise the same rib thicknesses, and/or two or more looped ribs of looped rib(s) 127 (FIG. 1) can comprise different rib thicknesses. Notably, in many embodiments, rib span 539 can be measured at a midpoint of inner perimeter surface 129 (FIG. 1) and/or outer perimeter surface 128 (FIG. 1).

Further still, looped rib 122 (FIG. 1) can comprise rib height 540. Rib height 540 can refer to a distance perpendicular from rear surface 115 (FIG. 1) to a center location of looped rib 122 (FIG. 1) farthest from rear surface 115 (i.e., where outer perimeter surface 128 (FIG. 1) interfaces with inner perimeter surface 129 (FIG. 1). In these or other embodiments, rib height 540 can be greater than or equal to approximately 0.3048 centimeters. In some embodiments, rib height 540 can be approximately 0.1778 cm to approximately 0.3048 cm. In some embodiments, rib height 540 can be approximately 0.17 cm, 0.20 cm, 0.23 cm, 0.26 cm, 0.29 cm, or 0.30 cm. In many embodiments, rib height 540 can be less than or equal to approximately 0.512 cm. In some embodiments, the height of looped rib 122 (FIG. 1) can vary throughout looped rib 122, and rib height 540 can be a maximum rib height of looped rib 122 (FIG. 1). In various embodiments, when looped rib(s) 127 (FIG. 1) comprises multiple looped ribs, two or more looped ribs of looped rib(s) 127 (FIG. 1) can comprise the same rib heights, and/or two or more looped ribs of looped rib(s) 127 (FIG. 1) can comprise different rib heights.

In many embodiments, center thickness 537, largest rib span 538, rib thickness 539, and/or rib height 540 can depend on one or more of each other. For example, center thickness 537 can be a function of rib thickness 539 and rib height 540. That is, for an increase in rib thickness 539 and/or rib height 540, center thickness 537 can be decreased, and vice versa. Meanwhile, rib thickness 539 and rib height 540 can be dependent on each other. For example, increasing rib thickness 539 can permit rib height 540 to be decreased, and vice versa.

Returning now to FIGS. 1 & 2, in many embodiments, perimeter wall element 113 can comprise a first perimeter wall portion 124 and a second perimeter wall portion 125. Perimeter wall element 113 extends (i) at least partially (e.g., entirely) around rear perimeter 119 of rear surface 115, (ii) out from rear surface 115 toward rear end 104 and (iii) away from front end 203 (FIG. 2). Meanwhile, first perimeter wall portion 124 can extend along rear perimeter 119 of rear surface 115 at top end 101, and second perimeter wall portion 125 can extend along rear perimeter 119 of rear surface 115 at bottom end 102. In many embodiments, reinforcement device 112 and reinforcement element(s) 120 are separate and/or located away from perimeter wall element 113 at rear surface 115 so that reinforcement device 112 and reinforcement element(s) 120 float at rear surface 115. By floating reinforcement device 112 and reinforcement element(s) 120, face element 111 can be permitted to bend approximately symmetrically about face center 216 (FIG. 2).

In many embodiments, club head body 110 can comprise (i) a top surface 132 at least partially at first perimeter wall portion 124 and/or top end 101, and/or (ii) a sole surface 133 at least partially at second perimeter wall portion 125 and/or bottom end 102. Accordingly, in some embodiments, first perimeter wall portion 124 can comprise at least part of top surface 132; and/or second perimeter wall portion 125 can comprise at least part of sole surface 133. Further, top surface 132 can interface with face surface 214 (FIG. 2) at top end 101; and/or sole surface 133 can interface with face surface 214 (FIG. 2) at bottom end 102.

In some embodiments, at least part of second perimeter wall portion 125 can be approximately equal thickness with or thinner than face element 111 at face perimeter 217 (FIG. 2) and/or proximal to face perimeter 217. For example, second perimeter wall portion 125 can be equal thickness with or thinner than face element 111 at face perimeter 217 (FIG. 2) and/or proximal to face perimeter 217 at a portion of second perimeter wall portion 125 that is proximal to face perimeter 217 (i.e., where second perimeter wall portion 125 interfaces with face element 111). Implementing this portion of second perimeter wall portion 125 to be equal thickness with or thinner than face element 111 at face perimeter 217 (FIG. 2) and/or proximal to face perimeter 217 can prevent stress risers from forming at second perimeter wall portion 125 when face surface 214 (FIG. 2) impacts a golf ball.

Rear surface 115 comprises a first rear surface portion and a second rear surface portion. The first rear surface portion can refer to the part of rear surface 115 covered by perimeter wall element 113, and the second rear surface portion can refer to the remaining part of rear surface 115. In many embodiments, reinforcement element 121 (e.g., looped rib 122) can cover greater than or equal to approximately 25 percent of a surface area of the second rear surface portion of rear surface 115 and/or less than or equal to approximately 40 percent of a surface area of the second rear surface portion of rear surface 115. In other embodiments, reinforcement element 121 (e.g., looped rib 122) can cover greater than or equal to approximately 30 percent of a surface area of the second rear surface portion of rear surface 115. In some embodiments, reinforcement element 121 (e.g., looped rib 122) can cover approximately 25 percent, 28 percent, 31 percent, 34 percent, 37 percent or 40 percent of a surface area of the second rear surface portion of rear surface 115.

Further, club head body 110 can comprise hosel 134 or any other suitable mechanism (e.g., a bore) for receiving and coupling a shaft to club head 100 and/or club head body 110. The other suitable mechanism can be similar to hosel 134 in one or more respects.

Meanwhile, generally speaking, hosel 134 can be located at or proximate to heel end 106. Although a shaft is not illustrated at the drawings, hosel 134 can be configured to receive a shaft (i.e., via an opening of hosel 134), such as, for example, a golf club shaft. Accordingly, hosel 134 can receive the shaft and permit the shaft to be coupled (e.g., permanently or removably) to club head 100 and/or club head body 110 when hosel 134 receives the shaft.

Further, in some embodiments, second perimeter wall portion 125 can comprise weight cavity 135. In these embodiments, weight cavity 135 can be configured to receive a removable or permanent weighted insert. The weighted insert can be positioned in weight cavity 135 such that the weighted insert is positioned closer to the bottom end 102 of club head 100 than the center of gravity of club head 100. In other words, the weighted insert can be positioned in weight cavity 135 such that the center of gravity of club head 100 is positioned closer to the top end 101 of club head 100 than the weighted insert. The weighted insert can be configured to alter a center of gravity of club head 100.

Figure 7:
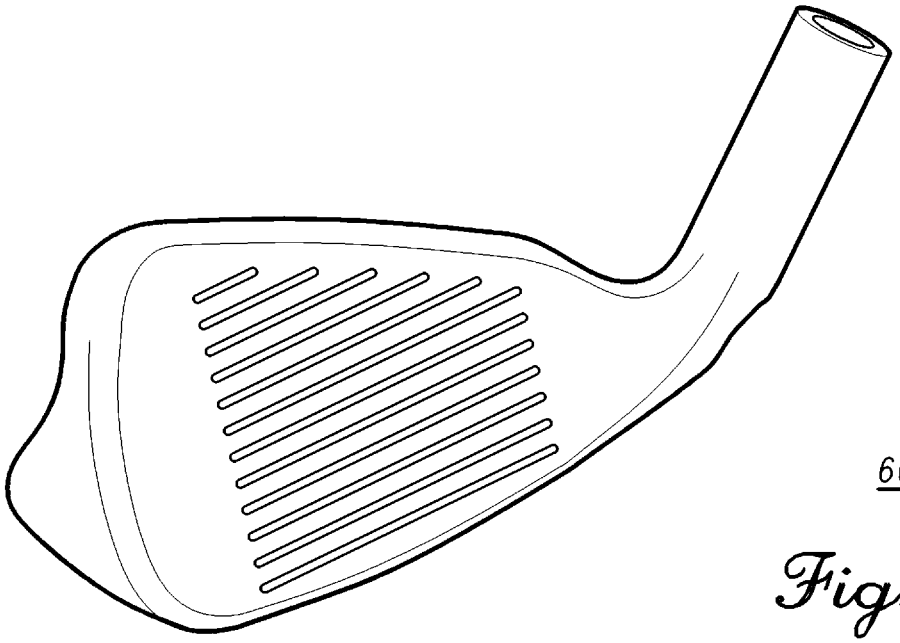
FIG. 7 illustrates a top, front, toe side view of the club head, according to the embodiment of FIG. 6.

Turning ahead in the drawings, FIG. 6 illustrates a top, rear, toe side view of a club head 600, according to an embodiment. Meanwhile, FIG. 7 illustrates a top, front, toe side view of club head 600, according to the embodiment of FIG. 6.

Club head 600 can be similar or identical to club head 100 (FIG. 1). Accordingly, club head 600 can comprise reinforcement device 612, and reinforcement device 612 can comprise reinforcement element(s) 620. Reinforcement device 612 can be similar or identical to reinforcement device 112 (FIG. 1); and reinforcement element(s) 620 can be similar or identical to reinforcement element(s) 120 (FIG. 1).

Reinforcement element(s) 620 can comprise first reinforcement element 621 and second reinforcement element 641. First reinforcement element 621 and/or second reinforcement element 641 each can be similar to first reinforcement element 121 (FIG. 1). Accordingly, first reinforcement element 621 can comprise first looped rib 622, and second reinforcement element 641 can comprise second looped rib 642. First looped rib 622 and/or second looped rib 642 each can be similar to looped rib 122 (FIG. 1).

In these embodiments, first reinforcement element 621 and/or first looped rib 622 can comprise a circular looped rib, and second reinforcement element 622 and/or second looped rib 642 can comprise an elliptical looped rib. Second reinforcement element 622 and/or second looped rib 642 can enclose first reinforcement element 621 and/or first looped rib 622. In many embodiments, a major axis of the elliptical looped rib can be approximately parallel with an x-axis of club head 600. The x-axis can be similar or identical to x-axis 107 (FIG. 1). In the same or different embodiments, the minor axis of the elliptical looped rib can be non-parallel with a y-axis of club head 600. The y-axis can be similar or identical to y-axis 108 (FIG. 1).

Club head 600 having reinforcement device 612 may also have uniform transition thickness 550 (not shown) extending from front end 203 to bottom end 102. Uniform transition thickness 550 absorbs stress directed to the region of club head 600 having reinforcement device 612 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

In another embodiment, FIG. 8 illustrates a side view of club head 800 taken along section line 5-5 of FIG. 2, according to a different embodiment of FIG. 1. Club head 800 shown in FIG. 8 illustrates an insert 805 within cavity 131. FIG. 9 illustrates a top, rear, heel side view of club head 800, according to the embodiment of FIG. 8. In some embodiments, insert 805 can be a vibration attenuating feature. Insert 805 can be a non-metallic material, an elastomeric material such as polyurethane, or another material such as foam. Insert 805 can be used to adjust the sound and feel of club head 800. By absorbing or damping vibration, insert 805 improves the feel of club head 800. In addition, insert 805 absorbs the sound of a golf ball striking the face, making golf club 800 head feel less hollow and more solid. In further embodiments, a badge (not shown) can at least partially cover cavity 131. The badge can be separate from insert 805 or can be integral with insert 805. In other embodiments, the badge can be integral with the reinforcement element, such as reinforcement element 120 (FIG. 1).

In some cases, the weight of insert 805 can be less than about 3 g so as to not significantly affect the swing weight or the center of gravity of club head 800. In other embodiments, insert 805 weight can be more than about 3 g, such as about 5 g to about 10 g, and can contribute substantially to the swing weight and/or the center of gravity of club head 800. In some embodiments, insert 805 can be adhered to cavity 131 using an epoxy adhesive, a viscoelastic foam tape, the vibration attenuating feature, or a high strength tape such as 3M™ VHB™ tape. In other embodiments, insert 805 can be poured and bonded directly into cavity 131. The badge can be bonded with similar adhesives. In some embodiments, insert 805 or the badge can be flush with looped rib 122 (FIG. 1) at the top of rib height 540, or they can be below rib height 540 when fully assembled.

In some embodiments, at least one vibration attenuating feature (e.g., insert 805 (FIG. 8) can be disposed on rear surface 115 (FIG. 1) of the golf club head, such as golf club head 800. The vibration attenuating feature can produce a more desirable sound from the golf club head 800 upon impact. The thin face element 111 (FIG. 1) of golf club head 800 can cause undesirable sounds when striking a golf ball. The vibration attenuating feature can reduce the vibrations leading to a more desirable sound on impact by thin face element 111 (FIG. 1). By providing a more desirable noise, the vibration attenuating component can increase a user's confidence during use. The vibration attenuating feature can also reduce the vibrational shock felt by the user of the golf club upon striking the golf ball. Furthermore, the vibration attenuating feature may reduce vibrational fatigue to decrease wear on golf club 800 and various features such as, but not limited to, cavity 131 or weight cavity 135 (FIG. 1). The reduced vibrational fatigue can further lower the risk of loosening or displacement of parts such as, but not limited to, insert 805 of cavity 131 or an insert in weight cavity 135 (FIG. 1). The reduced vibrational fatigue may extend the performance life of golf club head 800.

Figure 12:
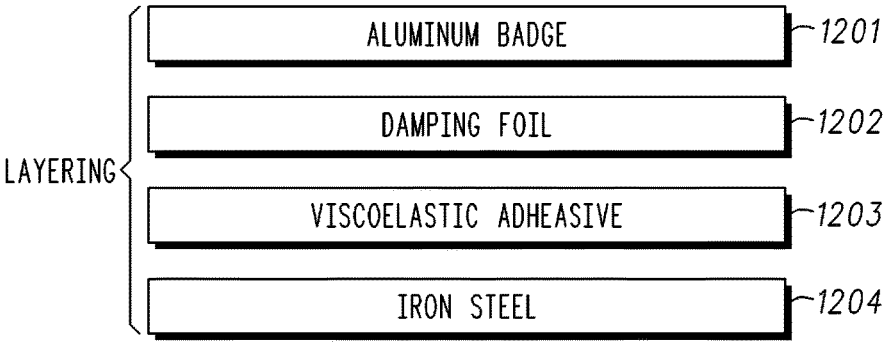
FIG. 12 illustrates a diagram for an embodiment of the layers of a vibration attenuating feature.

As seen in FIG. 12, in further embodiments, the vibration attenuating feature may comprise at least one layer of a viscoelastic damping material. The damping material may comprise a pressure sensitive viscoelastic acrylic polymer and aluminum foil forming a damping foil 1202 such as 3M™ Damping Foil Tape 2552. The damping foil 1202 may comprise an adhesive layer. In one embodiment the vibration attenuating feature may comprise at least one viscoelastic adhesive layer 1203 which may comprise a composition of varying layers of at least one layer of epoxy adhesive, a viscoelastic foam tape, and/or a high strength tape such as 3M™ VHB™ tape. In some embodiments, the vibration attenuating feature may comprise various layer combinations of at least one of viscoelastic adhesive 1203, damping foil 1202, and/or a badge 1201.

Returning to FIG. 8, in some embodiments, the vibration attenuating feature can be disposed on the rear surface 115 (FIG. 1) of the golf club head, such as golf club head 800, which comprises a rear surface material such as iron steel 1204. In another embodiment, the vibration attenuating feature can be disposed in cavity 131, or on or under insert 805 of the golf club head 800. The vibration attenuating feature can be located in various locations of the rear surface 115 (FIG. 1) of the golf club head 800. Generally, the vibration attenuating feature is at least partially located under the profile of the badge on the rear surface 115 (FIG. 1). In some embodiments, the vibration attenuating feature is disposed under the entirety of the badge profile. In other embodiments, the vibration attenuating feature is at least partially disposed under only particular regions of the badge profile such as the aluminum or elastomer regions. The vibration attenuating feature can be disposed under only at least part of the perimeter region of the badge profile. In some embodiments the vibration attenuating feature can be disposed at least partially in cavity 131 of the golf club head 800. The vibration attenuating feature may be disposed at least partially on or under insert 805 within cavity 131. In many embodiments the disposition of the vibration attenuating feature on golf club head 800 will comprise varying combinations the foil being disposed at least partially under the badge, at least partially over insert 805, at least partially in weight cavity 135 (FIG. 1), and/or at least partially in cavity 131. In some embodiments, the vibration attenuating feature will be disposed such that it covers at least 10 percent of the surface area of rear surface 115 (FIG. 1). In other embodiments, the vibration attenuating feature may cover at least 15, 20, 25, 30, 35, 40, 45, 50, 55, 60, 65, 70, 75, 80, 85, 90, 95, or 100 percent of the surface area of rear surface 115.

Club head 800 having insert 805 may also have uniform transition thickness 550 (FIG. 8) extending from front end 203 to bottom end 102. Uniform transition thickness 550 absorbs stress directed to the region of club head 800 having insert 805 between front end 203 and bottom end 102. Uniform transition thickness 550 may range from approximately 0.20-0.80 inches. For example, uniform transition thickness 550 may be approximately 0.20, 0.25, 0.30, 0.35 0.40, 0.45, 0.50, 0.55, 0.60, 0.65, 0.70, 0.75, or 0.80 inches.

The golf club head 100, 300, 600, 800 can be part of a set of club heads having varying loft angles. In some embodiments, center thickness 537, face thickness 542 outside reinforcement element 120, top thickness 546, bottom thickness 548, face thickness at rib height 540, or a combination of the described thicknesses can vary with loft angle of the club heads within the set of club heads.

Figure 10:
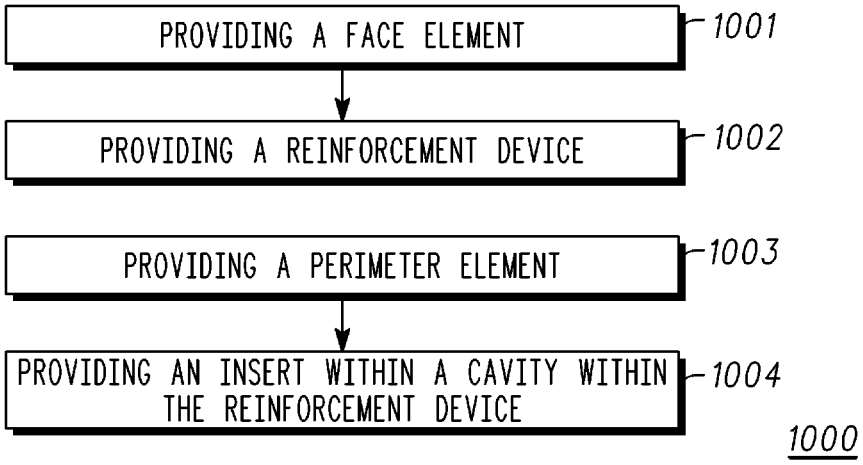
FIG. 10 illustrates a flow chart for an embodiment of a method of providing a golf club head.

Turning now to the next drawing, FIG. 10 illustrates a flow chart for an embodiment of method 1000 of providing a golf club head. Method 1000 is merely exemplary and is not limited to the embodiments presented herein. Method 1000 can be employed in many different embodiments or examples not specifically depicted or described herein. In some embodiments, the activities, the procedures, and/or the processes of method 1000 can be performed in the order presented. In other embodiments, the activities, the procedures, and/or the processes of method 1000 can be performed in any other suitable order. In still other embodiments, one or more of the activities, the procedures, and/or the processes in method 1000 can be combined or skipped. In many embodiments, the golf club head can be similar or identical to golf club head 100 (FIGS. 1 & 2), golf club head 600 (FIGS. 6 & 7), and/or golf club head 800 (FIGS. 8 & 9).

Method 1000 can comprise an activity 1001 of providing a face element. The face element can be similar or identical to face element 111 (FIG. 1).

Figure 11:
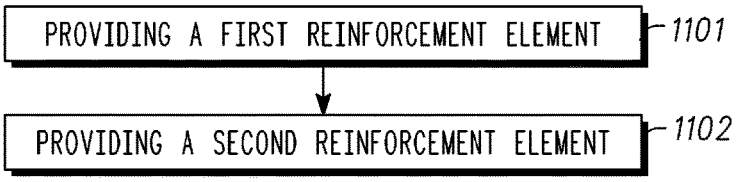
FIG. 11 illustrates an exemplary activity of providing a reinforcement device, according to the embodiment of FIG. 10.

Method 1000 can comprise an activity 1002 of providing a reinforcement device. The reinforcement device can be similar or identical to reinforcement device 112 (FIG. 1). FIG. 11 illustrates an exemplary activity 1002, according to the embodiment of FIG. 10.

For example, activity 1002 can comprise an activity 1101 of providing a first reinforcement element. The first reinforcement element can be similar or identical to first reinforcement element 121 (FIG. 1), reinforcement element 621 (FIG. 6), any one reinforcement element of reinforcement element(s) 120 (FIG. 1), and/or any one reinforcement element of reinforcement element(s) 620 (FIG. 6).

Further, activity 1002 can comprise an activity 1102 of providing a second reinforcement element. The second reinforcement element can be similar or identical to second reinforcement element 641 (FIG. 6) and/or any one reinforcement element of reinforcement element(s) 620 (FIG.

6). In some embodiments, activity 1101 and activity 1102 can be performed approximately simultaneously. In other embodiments, activity 1102 can be omitted.

Turning back to FIG. 10, method 1000 can comprise an activity 1003 of providing a perimeter wall element. The perimeter wall element can be similar or identical to perimeter wall element 113 (FIG. 1). In some embodiments, activity 1003 can be omitted.

In some embodiments, method 1000 can comprise an activity 1004 of providing an insert within a central cavity within the reinforcement device provided in activity 1002. In some embodiments, activity 1004 can be omitted.

In many embodiments, two or more of activities 1001-1004 can be performed sequentially or can be performed approximately simultaneously with each other. In these or other embodiments, activities 1001-1004 can be performed implementing any suitable manufacturing techniques (e.g., casting, forging, molding, machining, joining, etc.).

Although the golf club head(s) and related methods herein have been described with reference to specific embodiments, various changes may be made without departing from the spirit or scope of the present disclosure. For example, to one of ordinary skill in the art, it will be readily apparent that activities 1001-1004 of FIG. 10 and activities 1101 and 1102 of FIG. 11 may be comprised of many different procedures, processes, and activities and be performed by many different modules, in many different orders, that any element of FIGS. 1-4 may be modified, and that the foregoing discussion of certain of these embodiments does not necessarily represent a complete description of all possible embodiments.

Further, while the above examples may be described in connection with an iron-type golf club head, the apparatus, methods, and articles of manufacture described herein may be applicable to other types of golf clubs such as a wood-type golf club or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

Clause 1: A golf club head comprising a top end and a bottom end opposite the top end, a front end and a rear end opposite the front end, a toe end and a heel end opposite the toe end; a face element comprising, a face surface located at the front end and comprising a face center and a face perimeter; and a rear surface located at the rear end and being approximately opposite to the face surface, the rear surface comprising a rear center approximately opposite the face center and a rear perimeter, and a reinforcement device located at the rear surface; wherein, an x-axis extends approximately parallel to the face surface and intersects the rear center, a y-axis extends approximately parallel to the face surface, extends approximately perpendicular to the x-axis, and intersects the rear center, a z-axis extends approximately perpendicular to the face surface, extends approximately perpendicular to the x-axis and the y-axis, and intersects the rear center, the x-axis extends through the toe end and the heel end and equidistant between the top end and the bottom end, the y-axis extends through the top end and the bottom end and equidistant between the toe end and the heel end, the z-axis extends through the front end and the rear end and equidistant (i) between the toe end and the heel end and (ii) between the top end and the rear end, the reinforcement device comprises a reinforcement element comprising a geometric center approximately located at the z-axis, the reinforcement element extends out from the rear surface toward the rear end and away from the front end, the reinforcement element comprises a looped rib; and the face surface is nearer to the rear surface proximal to the face center than proximal to the face perimeter.

Clause 2: The golf club head of clause 1, wherein the face surface comprises one or more scoring lines extending between the toe end and the heel end.

Clause 3: The golf club head of clause 1, wherein the golf club head comprises an iron-type golf club head.

Clause 4: The golf club head of clause 1, wherein at least one of the rear surface is nearer to the face surface at the face center than proximal to the face perimeter, or a center thickness from the face center to the rear center is less than or equal to approximately 0.203 centimeters.

Clause 5: The golf club head of clause 1, wherein at least one of the looped rib is symmetric about the x-axis, or looped rib is symmetric about the y-axis.

Clause 6: The golf club head of clause 5, wherein the looped rib comprises an elliptical looped rib.

Clause 7: The golf club head of clause 6, wherein the elliptical looped rib comprises a circular looped rib.

Clause 8: The golf club head of clause 1, wherein the reinforcement element comprises an outer perimeter surface, the looped rib comprises an outer perimeter surface and an inner perimeter surface, the outer perimeter surface of the reinforcement element comprises the outer perimeter surface of the looped rib, and at least one of the outer perimeter surface of the reinforcement element is filleted with the rear surface, or the inner perimeter surface of the looped rib is filleted with the rear surface.

Clause 9: The golf club head of clause 1, wherein the looped rib comprises an inner perimeter surface, the looped rib comprises a cavity defined by the inner perimeter surface and the rear surface, and the cavity is devoid of a weighted insert.

Clause 10: The golf club head of clause 1, wherein the looped rib comprises an inner perimeter surface, the looped rib comprises a cavity defined by the inner perimeter surface and the rear surface, and the cavity contains an insert.

Clause 11: The golf club head of clause 10, wherein the insert comprises an elastomer or a foam.

Clause 12: The golf club head of clause 10, wherein the cavity is at least partially covered by a badge.

Clause 13: The golf club head of clause 12, wherein the badge is integral with the insert.

Clause 14: The golf club head of clause 12, wherein a weight of the insert is approximately 3 grams or less.

Clause 15: The golf club head of clause 12, wherein a combined weight of the insert and the badge is approximately 8 grams or less.

Clause 16: The golf club head of clause 10, wherein the rear surface at least partially comprises a vibration attenuating feature disposed thereon.

Clause 17: The golf club head of clause 16, wherein the vibration attenuating feature comprises a damping foil disposed on the rear surface of the golf club head, and at least one of a badge at least partially covering the rear surface of the golf club head, or a badge at least partially covering the cavity.

Clause 18: The golf club head of clause 17, wherein the damping foil is located between the badge and at least one of the rear surface of the golf club head or the cavity.

Clause 19: The golf club head of clause 17, wherein the badge comprises at least one aluminum region and damping foil is located between the aluminum region and at least one of the rear surface of the golf club head or the cavity.

Clause 20: The golf club head of clause 1, wherein the golf club head further comprises a perimeter wall element extending out from the rear surface toward the rear end and away from the front end, the perimeter wall element comprising a first perimeter wall portion extending along the perimeter of the rear surface at the top end, and a second perimeter wall portion extending along the perimeter of the rear surface at the bottom end.

Clause 21: The golf club head of clause 16, wherein at least part of the second perimeter wall portion is thinner than is the face element proximal to the face perimeter.

Clause 22: The golf club head of clause 16, wherein the second perimeter wall portion comprises a weight cavity configured to receive a weighted insert.

Clause 23: The golf club head of clause 18, wherein the weighted insert weighs between approximately 5 grams and approximately 10 grams.

Clause 24: The golf club head of clause 16, wherein the rear surface comprises a first rear surface portion and a second rear surface portion, the perimeter wall element extends entirely around the perimeter of the rear surface and covers the first rear surface portion, the second rear surface portion comprises a surface area, and the reinforcement element covers at least approximately 25 percent of the surface area.

Clause 25: The golf club head of clause 1, wherein the reinforcement element comprises an outer perimeter surface, the looped rib comprises an outer perimeter surface and an inner perimeter surface, the outer perimeter surface of the reinforcement element comprises the outer perimeter surface of the looped rib, and the inner perimeter surface comprises a largest rib span of greater than or equal to approximately 0.609 centimeters and less than or equal to approximately 1.88 centimeters.

Clause 26: The golf club head of clause 1, wherein the reinforcement element comprises an outer perimeter surface, the looped rib comprises an outer perimeter surface and an inner perimeter surface, the outer perimeter surface of the reinforcement element comprises the outer perimeter surface of the looped rib, and a rib thickness between the inner perimeter surface of the looped rib and the outer perimeter surface of the looped rib is approximately 0.0508 centimeters to approximately 1.448 centimeters.

Clause 27: The golf club head of clause 1, wherein the looped rib comprises a rib height and the rib height is approximately 0.1778 centimeters to approximately 0.3048 centimeters.

Clause 28: The golf club head of clause 23, wherein the looped rib comprises an inner perimeter surface and the inner perimeter surface of the looped rib at the rib height is substantially orthogonal to the rear surface.

Clause 29: The golf club head of clause 1, wherein the looped rib comprises a rib height and the rib height is largest in a middle region of the looped rib.

Clause 30: The golf club head of clause 1, wherein the reinforcement element comprises a first reinforcement element, the looped rib comprises a first looped rib, the reinforcement device comprises a second reinforcement element, the second reinforcement element comprises a second looped rib, and the second looped rib is approximately concentric with the first looped rib.

Clause 31: An iron-type golf club head comprising a top end and a bottom end opposite the top end, a front end and a rear end opposite the front end, a toe end and a heel end opposite the toe end, a face element comprising a face surface located at the front end and comprising a face center and a face perimeter and a rear surface located at the rear end and being approximately opposite to the face surface, the rear surface comprising a rear center approximately opposite the face center and a rear perimeter, a reinforcement device located at the rear surface, a perimeter wall element (i) extending out from the rear surface toward the rear end and away from the front end and (ii) extending entirely around the perimeter of the rear surface, the perimeter wall element comprising a first perimeter wall portion extending along the perimeter of the rear surface at the top end and a second perimeter wall portion extending along the perimeter of the rear surface at the bottom end, wherein an x-axis extends approximately parallel to the face surface and intersects the rear center, a y-axis extends approximately parallel to the face surface, extends approximately perpendicular to the x-axis, and intersects the rear center, a z-axis extends approximately perpendicular to the face surface, extends approximately perpendicular to the x-axis and the y-axis, and intersects the rear center, the x-axis extends through the toe end and the heel end and equidistant between the top end and the bottom end, the y-axis extends through the top end and the bottom end and equidistant between the toe end and the heel end, the z-axis extends through the front end and the rear end and equidistant (i) between the toe end and the heel end and (ii) between the top end and the rear end, the reinforcement device comprises a reinforcement element comprising a geometric center approximately located at the z-axis, the reinforcement element extends out from the rear surface toward the rear end and away from the front end, the reinforcement element comprises a closed circular looped rib, the golf club head comprises an iron-type golf club head, a center thickness from the face center to the rear center is greater than or equal to approximately 0.203 centimeters, and at least part of the second perimeter wall portion is thinner than is the face element proximal to the face perimeter.

Clause 32: The iron-type golf club head of clause 27, wherein the reinforcement element comprises a first reinforcement element, the reinforcement device comprises a second reinforcement element, the second reinforcement element comprises a closed elliptical looped rib enclosing the closed circular looped rib, the closed elliptical looped rib is approximately concentric with the closed circular looped rib, the closed elliptical looped rib comprises a major axis approximately parallel with the x-axis.

Clause 33: A method of providing a golf club head, the method comprising providing a face element comprising a face surface located at the front end and comprising a face center and a face perimeter and a rear surface located at the rear end and being approximately opposite to the face surface, the rear surface comprising a rear center approximately opposite the face center and a rear perimeter, and providing a reinforcement device at the rear surface, wherein the golf club head comprises a top end and a bottom end opposite the top end, a front end and a rear end opposite the front end, and a toe end and a heel end opposite the toe end, an x-axis extends approximately parallel to the face surface and intersects the rear center, a y-axis extends approximately parallel to the face surface, extends approximately perpendicular to the x-axis, and intersects the rear center, a z-axis extends approximately perpendicular to the face surface, extends approximately perpendicular to the x-axis and the y-axis, and intersects the rear center, the x-axis extends through the toe end and the heel end and equidistant between the top end and the bottom end, the y-axis extends through the top end and the bottom end and equidistant between the toe end and the heel end, the z-axis extends through the front end and the rear end and equidistant (i) between the toe end and the heel end and (ii) between the top end and the rear end, providing the reinforcement device comprises providing a reinforcement element comprising a geometric center approximately located at the z-axis, the reinforcement element extends out from the rear surface toward the rear end and away from the front end, the reinforcement element comprises a looped rib, and the face surface is nearer to the rear surface proximal to the face center than proximal to the face perimeter.

Clause 34: The method of clause 29, wherein the looped rib comprises an inner perimeter surface, the looped rib comprises a central cavity defined by the inner perimeter surface and the rear surface, and the central cavity contains an insert.

Clause 35: The method of clause 29, wherein the reinforcement element comprises a first reinforcement element, the looped rib comprises a first looped rib, providing the reinforcement device further comprises providing a second reinforcement element, the second reinforcement element comprises a second looped rib, and the second looped rib is approximately concentric with the first looped rib.

Clause 36: A golf club comprising a shaft and a golf club head coupled to the shaft, the golf club head comprising a top end and a bottom end opposite the top end, a front end and a rear end opposite the front end, a toe end and a heel end opposite the toe end a face element comprising a face surface located at the front end and comprising a face center and a face perimeter and a rear surface located at the rear end and being approximately opposite to the face surface, the rear surface comprising a rear center approximately opposite the face center and a rear perimeter, and a reinforcement device located at the rear surface, wherein an x-axis extends approximately parallel to the face surface and intersects the rear center, a y-axis extends approximately parallel to the face surface, extends approximately perpendicular to the x-axis, and intersects the rear center, a z-axis extends approximately perpendicular to the face surface, extends approximately perpendicular to the x-axis and the y-axis, and intersects the rear center, the x-axis extends through the toe end and the heel end and equidistant between the top end and the bottom end, the y-axis extends through the top end and the bottom end and equidistant between the toe end and the heel end, the z-axis extends through the front end and the rear end and equidistant (i) between the toe end and the heel end and (ii) between the top end and the rear end, the reinforcement device comprises a reinforcement element comprising a geometric center approximately located at the z-axis, the reinforcement element extends out from the rear surface toward the rear end and away from the front end, the reinforcement element comprises a looped rib, and the face surface is nearer to the rear surface proximal to the face center than proximal to the face perimeter.

Clause 37: A golf club head comprising a top end and a bottom end opposite the top end; a front end and a rear end opposite the front end; a toe end and a heel end opposite the toe end; a face element comprising: a face surface located at the front end and comprising a face center and a face perimeter; and a rear surface located at the rear end and being approximately opposite to the face surface, the rear surface comprising a rear center approximately opposite the face center and a rear perimeter; and a reinforcement device located at the rear surface; wherein an x-axis extends approximately parallel to the face surface and intersects the rear center; a y-axis extends approximately parallel to the face surface, extends approximately perpendicular to the x-axis, and intersects the rear center; a z-axis extends approximately perpendicular to the face surface, extends approximately perpendicular to the x-axis and the y-axis, and intersects the rear center; the x-axis extends through the toe end and the heel end and equidistant between the top end and the bottom end; the y-axis extends through the top end and the bottom end and equidistant between the toe end and the heel end; the z-axis extends through the front end and the rear end and equidistant (i) between the toe end and the heel end and (ii) between the top end and the rear end; the reinforcement device comprises a reinforcement element comprising a geometric center approximately located at the z-axis; the reinforcement element extends out from the rear surface toward the rear end and away from the front end; the reinforcement element comprises a looped rib having an outer perimeter surface and an inner perimeter surface; the face surface is nearer to the rear surface proximal to the face center than proximal to the face perimeter; the outer perimeter surface of the reinforcement element is filleted with the rear surface with a fillet having a radius of greater than or equal to approximately 0.012 centimeters; and the inner perimeter surface comprises a largest rib span of greater than or equal to approximately 0.609 centimeters to approximately 1.88 centimeters.

Clause 38: The golf club head of clause 37, wherein the face surface comprises one or more scoring lines extending between the toe end and the heel end.

Clause 39: The golf club head of clause 37, further comprising a lip positioned on the rear surface of the club head.

Clause 40: The golf club head of clause 37, wherein at least one of: the rear surface is nearer to the face surface at the face center than proximal to the face perimeter; or a center thickness from the face center to the rear center is less than or equal to approximately 0.203 centimeters.

Clause 41: The golf club head of clause 37, wherein at least one of: the looped rib is symmetric about the x-axis; or the looped rib is symmetric about the y-axis.

Clause 42: The golf club head of clause 41, wherein the looped rib comprises an elliptical looped rib.

Clause 43: The golf club head of clause 42, wherein the elliptical looped rib comprises a circular looped rib.

Clause 44: The golf club head of clause 37, wherein the inner perimeter surface of the looped rib is filleted with the rear surface.

Clause 45: The golf club head of clause 37, wherein the looped rib comprises a cavity defined by the inner perimeter surface and the rear surface; and the cavity is devoid of a weighted insert.

Clause 46: The golf club head of clause 37, wherein the looped rib comprises a cavity defined by the inner perimeter surface and the rear surface; and the cavity contains an insert.

Clause 47: The golf club head of clause 46, wherein the insert comprises an elastomer or a foam.

Clause 48: The golf club head of clause 46, wherein the rear surface at least partially comprises a vibration attenuating feature disposed thereon, the vibration attenuating feature comprises a damping foil disposed on the rear surface of the golf club head, and at least one of: a badge at least partially covering the rear surface of the golf club head; or a badge at least partially covering the cavity.

Clause 49: The golf club head of clause 48, wherein the damping foil is located between the badge and at least one of: the rear surface of the golf club head; or the cavity.

Clause 50: The golf club head of clause 37, wherein the golf club head further comprises a perimeter wall element extending out from the rear surface toward the rear end and away from the front end, the perimeter wall element comprising: a first perimeter wall portion extending along the perimeter of the rear surface at the top end; and a second perimeter wall portion extending along the perimeter of the rear surface at the bottom end.

Clause 51: The golf club head of clause 37, wherein the reinforcement element comprises an outer perimeter surface, the looped rib comprises an outer perimeter surface and an inner perimeter surface, the outer perimeter surface of the reinforcement element comprises the outer perimeter surface of the looped rib, and a rib thickness between the inner perimeter surface of the looped rib and the outer perimeter surface of the looped rib is approximately 0.0508 centimeters to approximately 1.448 centimeters.

Clause 52: A method of providing a golf club head, the method comprising:

providing a face element comprising a face surface located at the front end and comprising a face center and a face perimeter; and a rear surface located at the rear end and being approximately opposite to the face surface, the rear surface comprising a rear center approximately opposite the face center and a rear perimeter; and providing a reinforcement device at the rear surface; wherein: the golf club head comprises: a top end and a bottom end opposite the top end; a front end and a rear end opposite the front end; and a toe end and a heel end opposite the toe end; an x-axis extends approximately parallel to the face surface and intersects the rear center; a y-axis extends approximately parallel to the face surface, extends approximately perpendicular to the x-axis, and intersects the rear center; a z-axis extends approximately perpendicular to the face surface, extends approximately perpendicular to the x-axis and the y-axis, and intersects the rear center; the x-axis extends through the toe end and the heel end and equidistant between the top end and the bottom end; the y-axis extends through the top end and the bottom end and equidistant between the toe end and the heel end; the z-axis extends through the front end and the rear end and equidistant (i) between the toe end and the heel end and (ii) between the top end and the rear end; providing the reinforcement device comprises providing a reinforcement element comprising a geometric center approximately located at the z-axis; the reinforcement element extends out from the rear surface toward the rear end and away from the front end; the reinforcement element comprises a looped rib having an outer perimeter surface and an inner perimeter surface; the face surface is nearer to the rear surface proximal to the face center than proximal to the face perimeter; the outer perimeter surface of the reinforcement element is filleted with the rear surface with a fillet having a radius of greater than or equal to approximately 0.012 centimeters; and the inner perimeter surface comprises a largest rib span of greater than or equal to approximately 0.609 centimeters to approximately 1.88 centimeters.

Clause 53: The golf club head of clause 52, wherein the looped rib comprises a central cavity defined by the inner perimeter surface and the rear surface, and the central cavity contains an insert.

Clause 54: The golf club head of clause 52, wherein the reinforcement element comprises a first reinforcement element; the looped rib comprises a first looped rib; providing the reinforcement device further comprises providing a second reinforcement element; the second reinforcement element comprises a second looped rib; and the second looped rib is approximately concentric with the first looped rib.

Clause 55: A golf club comprising a shaft and a golf club head coupled to the shaft, the golf club head comprising a top end and a bottom end opposite the top end; a front end and a rear end opposite the front end; a toe end and a heel end opposite the toe end; a face element comprising: a face surface located at the front end and comprising a face center and a face perimeter; and a rear surface located at the rear end and being approximately opposite to the face surface, the rear surface comprising a rear center approximately opposite the face center and a rear perimeter; and a reinforcement device located at the rear surface; wherein an x-axis extends approximately parallel to the face surface and intersects the rear center; a y-axis extends approximately parallel to the face surface, extends approximately perpendicular to the x-axis, and intersects the rear center; a z-axis extends approximately perpendicular to the face surface, extends approximately perpendicular to the x-axis and the y-axis, and intersects the rear center; the x-axis extends through the toe end and the heel end and equidistant between the top end and the bottom end; the y-axis extends through the top end and the bottom end and equidistant between the toe end and the heel end; the z-axis extends through the front end and the rear end and equidistant (i) between the toe end and the heel end and (ii) between the top end and the rear end; the reinforcement device comprises a reinforcement element comprising a geometric center approximately located at the z-axis; the reinforcement element extends out from the rear surface toward the rear end and away from the front end; the reinforcement element comprises a looped rib having an outer perimeter surface and an inner perimeter surface; the face surface is nearer to the rear surface proximal to the face center than proximal to the face perimeter; the outer perimeter surface of the reinforcement element is filleted with the rear surface with a fillet having a radius of greater than or equal to approximately 0.012 centimeters; and the inner perimeter surface comprises a largest rib span of greater than or equal to approximately 0.609 centimeters to approximately 1.88 centimeters.

The golf club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a top end and a bottom end opposite the top end;
a front end and a rear end opposite the front end;
a toe end and a heel end opposite the toe end;
a face element comprising:
a face surface located at the front end and comprising a face center and a face perimeter; and
a rear surface located at the rear end and being approximately opposite to the face surface, the rear surface comprising a rear center approximately opposite the face center and a rear perimeter;
and
a reinforcement device located at the rear surface;
wherein:
an x-axis extends approximately parallel to the face surface and intersects the rear center;
a y-axis extends approximately parallel to the face surface, extends approximately perpendicular to the x-axis, and intersects the rear center;
a z-axis extends approximately perpendicular to the face surface, extends approximately perpendicular to the x-axis and the y-axis, and intersects the rear center;
the x-axis extends through the toe end and the heel end and equidistant between the top end and the bottom end;
the y-axis extends through the top end and the bottom end and equidistant between the toe end and the heel end;
the z-axis extends through the front end and the rear end and equidistant (i) between the toe end and the heel end and (ii) between the top end and the rear end;
the reinforcement device comprises a reinforcement element comprising a geometric center approximately located at the z-axis;
the reinforcement element extends out from the rear surface toward the rear end and away from the front end;
the reinforcement element comprises a looped rib having an outer perimeter surface and an inner perimeter surface;
the face element is thinner within the inner perimeter surface than outside the outer perimeter surface;
the outer perimeter surface of the reinforcement element is filleted with the rear surface with a fillet having a radius of greater than or equal to approximately 0.012 centimeters; and
the inner perimeter surface comprises a largest rib span of greater than or equal to approximately 0.609 centimeters to approximately 1.88 centimeters.

2. The golf club head of claim 1 wherein:
the face surface comprises one or more scoring lines extending between the toe end and the heel end.

3. The golf club head of claim 1 further comprising:
a lip positioned on the rear surface of the club head.

4. The golf club head of claim 1 wherein at least one of:
the rear surface is nearer to the face surface at the face center than proximal to the face perimeter; or
a center thickness from the face center to the rear center is less than or equal to approximately 0.203 centimeters.

5. The golf club head of claim 1 wherein at least one of:
the looped rib is symmetric about the x-axis; or
the looped rib is symmetric about the y-axis.

6. The golf club head of claim 5 wherein:
the looped rib comprises an elliptical looped rib.

7. The golf club head of claim 6 wherein:
the elliptical looped rib comprises a circular looped rib.

8. The golf club head of claim 1 wherein:
the inner perimeter surface of the looped rib is filleted with the rear surface.

9. The golf club head of claim 1 wherein:
the looped rib comprises a cavity defined by the inner perimeter surface and the rear surface; and
the cavity is devoid of a weighted insert.

10. The golf club head of claim 1 wherein:
the looped rib comprises a cavity defined by the inner perimeter surface and the rear surface; and
the cavity contains an insert.

11. The golf club head of claim 10 wherein:
the insert comprises an elastomer or a foam.

12. The golf club head of claim 10 wherein:
the rear surface at least partially comprises a vibration attenuating feature disposed thereon, the vibration attenuating feature comprises:
a damping foil disposed on the rear surface of the golf club head;
and at least one of:
a badge at least partially covering the rear surface of the golf club head; or
a badge at least partially covering the cavity.

13. The golf club head of claim 12 wherein:
the damping foil is located between the badge and at least one of:
the rear surface of the golf club head; or
the cavity.

14. The golf club head of claim 1 wherein:
the golf club head further comprises a perimeter wall element extending out from the rear surface toward the rear end and away from the front end, the perimeter wall element comprising:
a first perimeter wall portion extending along the perimeter of the rear surface at the top end; and
a second perimeter wall portion extending along the perimeter of the rear surface at the bottom end.

15. The golf club head of claim 1 wherein:
the reinforcement element comprises an outer perimeter surface;
the looped rib comprises an outer perimeter surface and an inner perimeter surface;
the outer perimeter surface of the reinforcement element comprises the outer perimeter surface of the looped rib; and a rib thickness between the inner perimeter surface of the looped rib and the outer perimeter surface of the looped rib is approximately 0.0508 centimeters to approximately 1.448 centimeters.

16. A method of providing a golf club head, the method comprising:

providing a face element comprising:

a face surface located at a front end and comprising a face center and a face perimeter; and a rear surface located at a rear end and being approximately opposite to the face surface, the rear surface comprising a rear center approximately opposite the face center and a rear perimeter;

and providing a reinforcement device at the rear surface;

wherein:

the golf club head comprises:

a top end and a bottom end opposite the top end;

the front end and the rear end opposite the front end; and a toe end and a heel end opposite the toe end;

an x-axis extends approximately parallel to the face surface and intersects the rear center;

a y-axis extends approximately parallel to the face surface, extends approximately perpendicular to the x-axis, and intersects the rear center;

a z-axis extends approximately perpendicular to the face surface, extends approximately perpendicular to the x-axis and the y-axis, and intersects the rear center;

the x-axis extends through the toe end and the heel end and equidistant between the top end and the bottom end;

the y-axis extends through the top end and the bottom end and equidistant between the toe end and the heel end;

the z-axis extends through the front end and the rear end and equidistant (i) between the toe end and the heel end and (ii) between the top end and the rear end;

providing the reinforcement device comprises providing a reinforcement element comprising a geometric center approximately located at the z-axis;

the reinforcement element extends out from the rear surface toward the rear end and away from the front end;

the reinforcement element comprises a looped rib having an outer perimeter surface and an inner perimeter surface;

the face element is thinner within the inner perimeter surface than outside, the outer perimeter surface;

the outer perimeter surface of the reinforcement element is filleted with the rear surface with a fillet having a radius of greater than or equal to approximately 0.012 centimeters; and the inner perimeter surface comprises a largest rib span of greater than or equal to approximately 0.609 centimeters to approximately 1.88 centimeters.

17. The method of claim 16 wherein:

the looped rib comprises a central cavity defined by the inner perimeter surface and the rear surface; and the central cavity contains an insert.

18. The method of claim 16 wherein:

the reinforcement element comprises a first reinforcement element;

the looped rib comprises a first looped rib;

providing the reinforcement device further comprises providing a second reinforcement element;

the second reinforcement element comprises a second looped rib; and the second looped rib is approximately concentric with the first looped rib.

19. A golf club comprising:

a shaft; and a golf club head coupled to the shaft, the golf club head comprising:

a top end and a bottom end opposite the top end;

a front end and a rear end opposite the front end;

a toe end and a heel end opposite the toe end;

a face element comprising:

a face surface located at the front end and comprising a face center and a face perimeter; and a rear surface located at the rear end and being approximately opposite to the face surface, the rear surface comprising a rear center approximately opposite the face center and a rear perimeter; and a reinforcement device located at the rear surface;

wherein:

an x-axis extends approximately parallel to the face surface and intersects the rear center;

a y-axis extends approximately parallel to the face surface, extends approximately perpendicular to the x-axis, and intersects the rear center;

a z-axis extends approximately perpendicular to the face surface, extends approximately perpendicular to the x-axis and the y-axis, and intersects the rear center;

the x-axis extends through the toe end and the heel end and equidistant between the top end and the bottom end;

the y-axis extends through the top end and the bottom end and equidistant between the toe end and the heel end;

the z-axis extends through the front end and the rear end and equidistant (i) between the toe end and the heel end and (ii) between the top end and the rear end;

the reinforcement device comprises a reinforcement element comprising a geometric center approximately located at the z-axis;

the reinforcement element extends out from the rear surface toward the rear end and away from the front end;

the reinforcement element comprises a looped rib having an outer perimeter surface and an inner perimeter surface;

the face element is thinner within the inner perimeter surface than outside the outer perimeter surface;

the outer perimeter surface of the reinforcement element is filleted with the rear surface with a fillet having a radius of greater than or equal to approximately 0.012 centimeters; and the inner perimeter surface comprises a largest rib span of greater than or equal to approximately 0.609 centimeters to approximately 1.88 centimeters.

* * * * *